US006216499B1

(12) United States Patent
Ronberg et al.

(10) Patent No.: US 6,216,499 B1
(45) Date of Patent: Apr. 17, 2001

(54) LAPTOP COMPUTER SECURITY DEVICE

(75) Inventors: M. Edwin Ronberg; Jean Charles Morin; Robert E. Mercer, all of Gloucester; Case J. Vandenbelt, Ottawa, all of (CA)

(73) Assignee: Computer Security Devices, Inc., Gloucester (CA)

( * ) Notice: Subject to any disclaimer, the term of this patent is extended or adjusted under 35 U.S.C. 154(b) by 0 days.

(21) Appl. No.: 09/383,223

(22) Filed: Aug. 26, 1999

(30) Foreign Application Priority Data

Aug. 26, 1998 (CA) ..... 2,246,139

(51) Int. Cl.[7] ..... E05B 69/00

(52) U.S. Cl. ..... 70/58; 70/19; 248/551; 361/681

(58) Field of Search ..... 70/14, 18, 19, 70/57, 58, 63; 248/551–553; 361/685, 686, 681, 732

(56) References Cited

U.S. PATENT DOCUMENTS

| | | | | |
|---|---|---|---|---|
| 4,585,202 | * | 4/1986 | Parsekian | 70/58 X |
| 4,884,420 | * | 12/1989 | Finkel et al. | 70/58 |
| 5,052,199 | * | 10/1991 | Derman | 70/19 X |
| 5,085,395 | * | 2/1992 | Frater et al. | 248/552 |
| 5,135,197 | * | 8/1992 | Kelley et al. | 70/58 X |
| 5,595,074 | * | 1/1997 | Munro | 70/19 X |
| 5,605,316 | * | 2/1997 | Kelley | 248/551 |
| 5,640,301 | * | 6/1997 | Roecker et al. | 248/551 X |
| 5,642,634 | * | 7/1997 | Perry | 70/18 |
| 5,644,471 | * | 7/1997 | Schultz et al. | 361/686 |
| 5,645,261 | * | 7/1997 | Glynn | 70/63 X |
| 5,660,451 | * | 8/1997 | Glynn | 70/58 X |
| 5,692,400 | * | 12/1997 | Bliven et al. | 70/58 |

(List continued on next page.)

FOREIGN PATENT DOCUMENTS

2134587 * 8/1984 (GB) ..... 70/58

OTHER PUBLICATIONS

Secure–It, Inc., "Secure–It Inc.—High Security Notepad", www.secure–it.com/products/notepad.htm, (1996).

Secure–It, Inc., "Notepad Instructions", www.secure–it-.com/products/instructions/notepad.htm (1996).

Loxit Computer Security Products, "The Deskcam . . . Security for laptops in use", www.loxit.com/laptop6.htm (date unknown).

(List continued on next page.)

*Primary Examiner*—Suzanne Dino Barrett
(74) *Attorney, Agent, or Firm*—Jones, Tullar & Cooper

(57) ABSTRACT

A security device for laptop- or notebook-type portable computers is provided for the securing of such a computer to a surface. The device comprises, in general a retainer for engaging the computer's display; positioning structure for moving the retainer into and out of engagement with the display; and a mounting structure therefor which is securable to the surface. The device includes a locking mechanism which functions to fix the position of the retainer a predetermined distance above the surface to trap the computer against the surface and, hence, prevent its removal. The device is adapted to quickly engage and disengage the computer and to provide a minimum of inconvenience with respect to the task of locking and unlocking the computer. When not in use, the device moves substantially out of the way so as to minimize obstruction of the surface on which the device is employed. The device not only presents a visible deterrent, but it also presents an evident and significant physical challenge for its defeat. The security device may also be mounted to a mini-table which is sized so as to be unable to be concealed easily under garments, coats, etc., or to fit within most briefcases or the like, hereby foiling the snatch, grab and hide techniques of most laptop thieves.

18 Claims, 16 Drawing Sheets

U.S. PATENT DOCUMENTS

| | | | | |
|---|---|---|---|---|
| 5,816,076 | * | 10/1998 | Biedermann et al. | 70/57 |
| 5,836,183 | * | 11/1998 | Derman | 70/58 |
| 5,847,924 | * | 12/1998 | Youn | 361/686 |
| 5,857,568 | * | 1/1999 | Speirs | 206/320 |
| 5,859,762 | * | 1/1999 | Clark et al. | 361/686 |
| 5,870,281 | * | 2/1999 | Kim | 361/681 |
| 5,870,283 | * | 2/1999 | Maeda et al. | 70/58 X |
| 5,946,186 | * | 8/1999 | Karl et al. | 361/686 |
| 6,047,572 | * | 4/2000 | Bliven et al. | 70/58 |

OTHER PUBLICATIONS

Secure Systems Services, "Laptop Security Stand", www.secureservices.com/ls/22649s.html (date unknown).

Secure Systems Services, "Laptop Security Stand—Details", www.secureservices.com/ls.22649d.html (date unknown).

* cited by examiner

LAPTOP COMPUTER SECURITY DEVICE

FIELD OF THE INVENTION

The invention relates to security devices for preventing theft of laptop or notebook type portable computers.

BACKGROUND OF THE INVENTION

The vast majority of theft involving laptop or notebook type computers results from leaving such systems unattended on a desktop. It takes only seconds to close a display, if opened, remove any peripheral connections and other cabling, and walk away with the computer. Due to their relatively small size, they can easily be concealed in a briefcase or under a coat. However, due to their popularity, it is not uncommon to see people walking with these computers underarm. Accordingly, a thief typically encounters no difficulty in leaving even fairly secure buildings with a stolen portable computer.

Much of this theft can be avoided simply by employing a visible security device which presents a time consuming task for its defeat and increases the deterrent effect.

Many of the security devices employed presently involve various arrangements of cables and locks. Some require modification of the computer system while others have cable lock ports built in. A variety of such devices are known for releasably securing the equipment to substantially immovable surfaces. Such surfaces may, for example, comprise the desk or table top, the floor, the side panel of a desk or cabinet, a wall surface or similar surfaces. The prior art is replete with devices which are affixed to the computer in one way or another and to which an anchored cable is then secured. Such devices provide little real protection other than as a simple deterrent since the cable can readily be severed with a pair of bolt or wire cutters, for example. Many of these devices also require a significant amount of time to engage and disengage the computer. Accordingly, even where available, users are reluctant to take the time to lock up the system when they leave their desk, workstation and/or office, even if only for a brief moment.

SUMMARY OF THE INVENTION

The present invention provides a security device for such laptop- or notebook-type portable computers which is adapted to quickly engage and disengage the computer and to provide a minimum if inconvenience with respect to the task of locking and unlocking the computer. In general, the device functions to trap the computer against the surface on which the computer rests. When not in use, the device may be moved substantially out of the way so as to minimize obstruction of the surface on which the device is employed. The device presents an evident and significant physical challenge for its defeat According to a first aspect of the invention, there is provided a security device for securing to a surface a portable computer having a deck and a display pivotably connected thereto, the security device comprising:

retaining means comprising front and rear retaining members spaced-apart by a pair of lateral retaining members, the front, rear and lateral retaining members forming an enclosure with respect to front, rear and lateral directions, the display being insertable through the enclosure;

positioning means for moving the retaining means from a first position where the retaining means is out of engagement with the display to a second position where the retaining means encloses the display when the computer is resting on the surface, and where the retaining means is positioned in a predetermined orientation above the surface whereby the spatial relationship of the front retaining member with respect to the rear retaining member and the front retaining member with respect to the surface being such that the display, and thereby the portable computer, is incapable of being withdrawn from the retaining means;

mounting mews for mounting the positioning means to the surface; and locking means for locking the retaining means in the second position In one embodiment the mounting means comprises an outer cylinder and the positioning means comprises:

an inner cylinder positioned coaxially within the outer cylinder and being rotatable therein, the inner cylinder being longer than the outer cylinder so that first and second ends of the inner cylinder extend outside the outer cylinder; and a pair of support arms extending from the first and second ends of the inner cylinder and being rigidly attached to the retaining means.

Preferably, the outer cylinder is fastened to the surface by a pair of fasteners whose unfastening elements are contained within the inner cylinder, the outer cylinder having a pair of holes through which the unfastening elements are accessible, and the inner cylinder has a pair of circumferentially-disposed slots through which the fibers extend, the inner cylinder having portions diametrically opposed to the slots, whereby when the retaining means is in the first position, the slots are in registration with the holes in the outer cylinder to permit access to the unfastening elements and when the retaining means is in the second position, the portions of inner cylinder underlie the holes to prevent access to the unfastening elements.

In a second embodiment, the mounting means comprises a base and the positioning means comprises a housing pivotally connected to the base and a supporting member rigidly affixed to the retaining means which extends from the housing. The lock means is operable to lock said housing to said base to thereby enclose a space. Preferably, the mounting means is secured to the surface by a plurality of first fasteners whose fastening elements are disposed relative to the base such that when the housing is locked onto the base, the unfastening elements are inaccessibly contained within said space.

The device is fabricated from finished high strength steel and utilizes other high strength components so as present an apparent time consuming task for its defeat. The device is easy to use, is relatively unobtrusive, and readily moves into and out of locking engagement with the laptop. The device need not be engaged at all times (i.e. while the computer is in use) due to its quick and automatic locking operation When unlocked, the device conveniently pivots out of the way, thereby permitting use of the work surface for other purposes, i.e. handwriting. However, when the user must leave the system unattended, it is a simple operation to engage the device upon leaving and disengage the system when returning.

The invention also provides for mounting the security device to a mini-table which is sized so as to be unable to be concealed easily under garments, coats, etc., or to fit within most briefcases or the like, thereby foiling the snatch, grab and hide techniques of most laptop thieves.

These and other objects and advantages of thee present invention will become apparent from the following detailed description of the invention when taken in conjunction with the drawings wherein: dr

BRIEF DESCRIPTION OF THE DRAWINGS

FIG. 22 is a side elevational view of this embodiment shown in its locked position;

FIG. 23 is a plan view of the embodiment shown in FIG. 22;

FIG. 24 is a side elevational and cross-sectional view as seen along lines XXIV—XXIV of FIG. 25 showing this embodiment in its unlocked position;

FIG. 25 is a plan view of the embodiment as shown in FIG. 24;

FIG. 26 is a bottom view of this embodiment;

FIG. 27 a side elevational view showing this embodiment in its inclined position.

DETAILED DESCRIPTION OF THE PREFERRED EMBODIMENT

Figure 1:
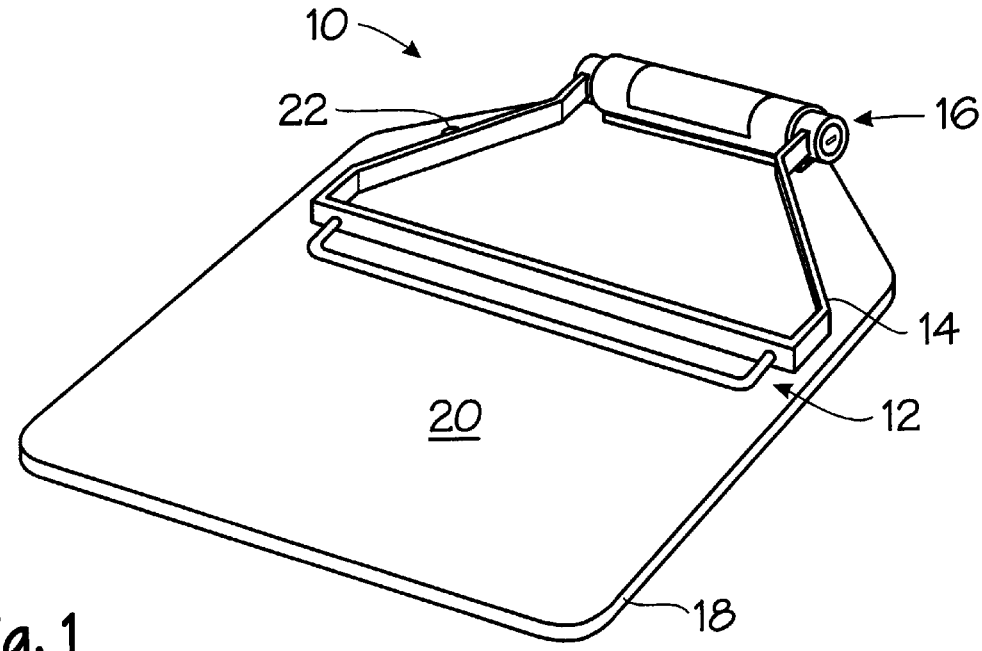
FIG. 1 is a perspective view of the preferred embodiment of the invention shown in its locked and closed position.
Figure 2:
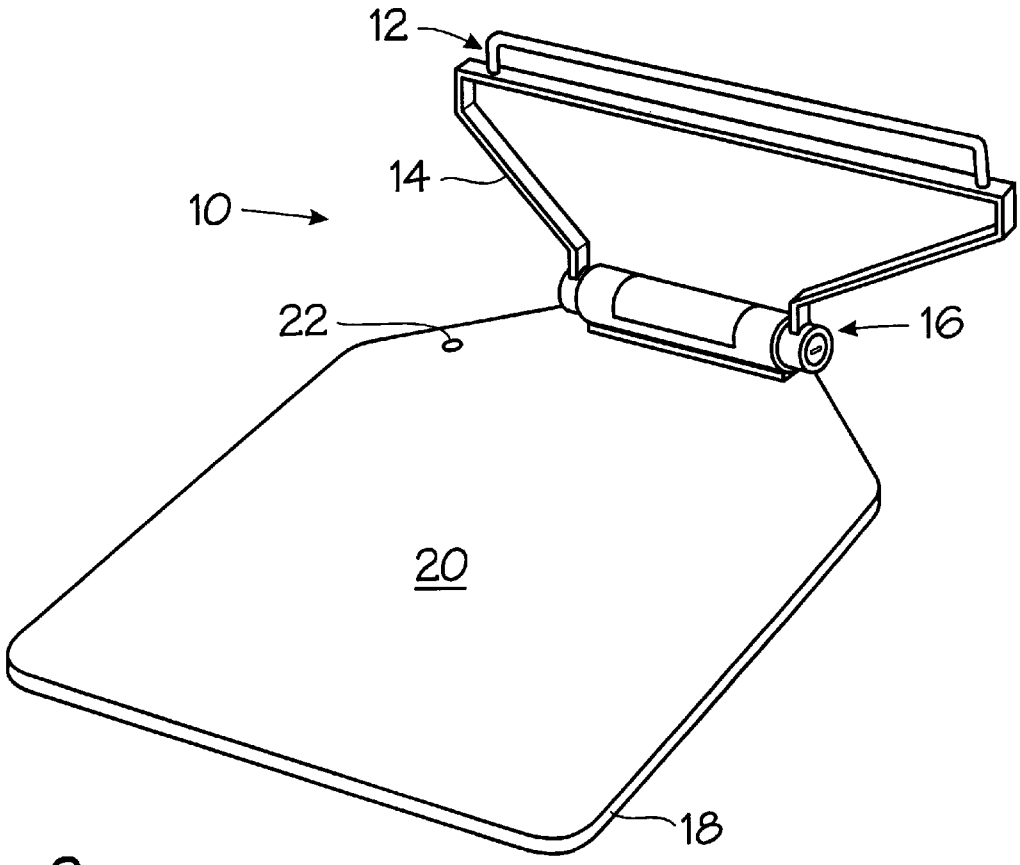
FIG. 2 is a perspective view of the laptop computer security apparatus of FIG. 1 shown in its unlocked and open position.
Figure 3A:
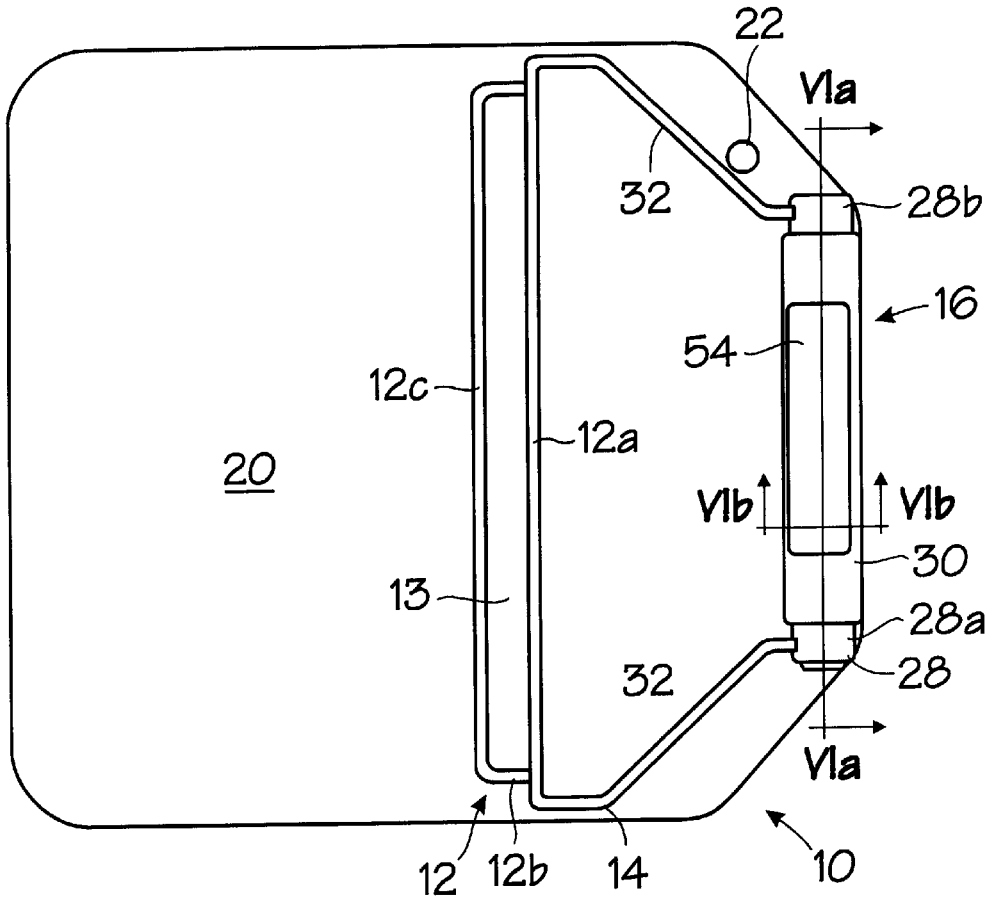
FIG. 3*a* is a plan view and FIG. 3*b* is a side elevational view of the security device shown in its locked and closed position.
Figure 3B:
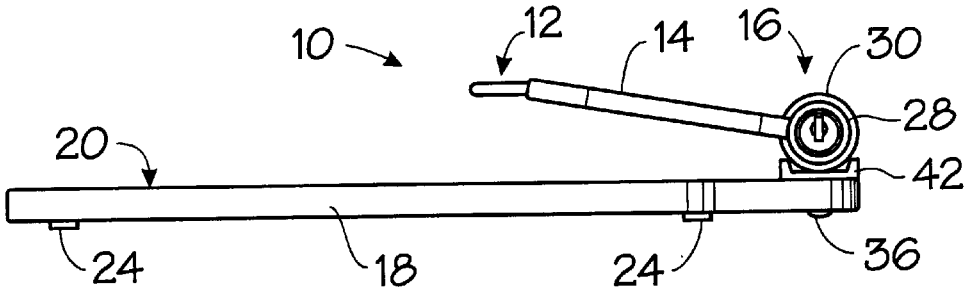
Figure 4A:
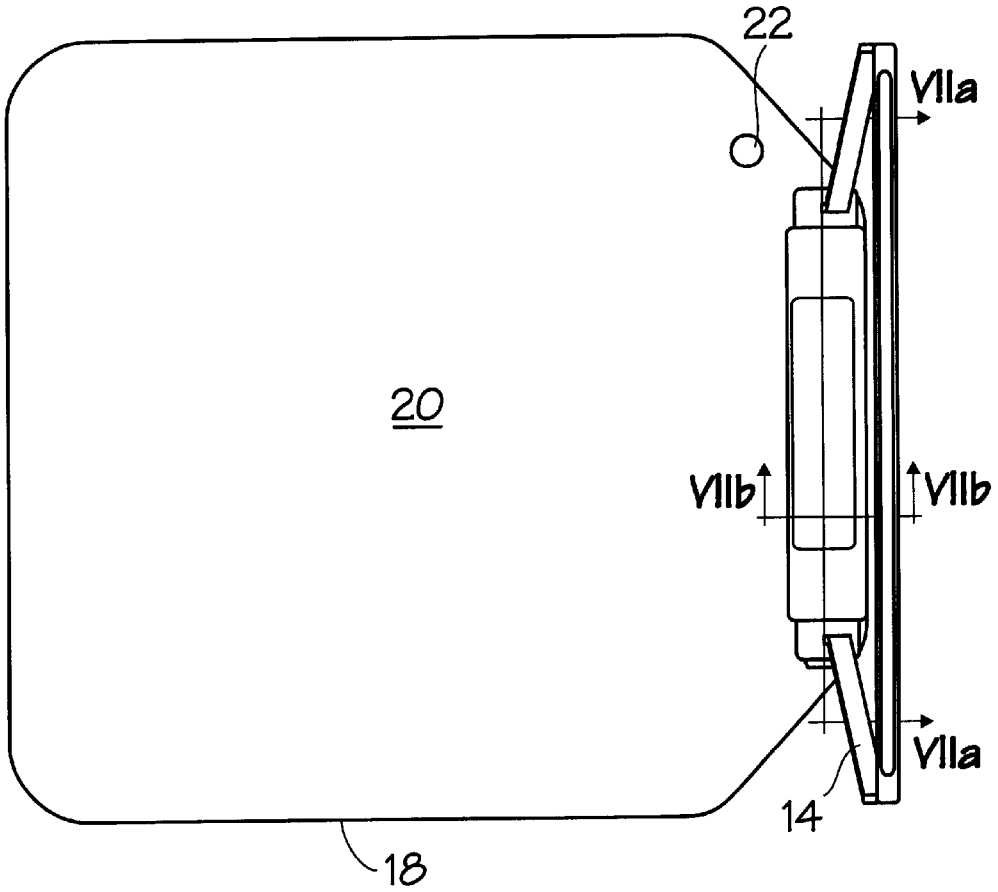
FIG. 4*a* is a plan view and FIG. 4*b* is a side elevational view of the security device shown in its unlocked and open position.
Figure 4B:
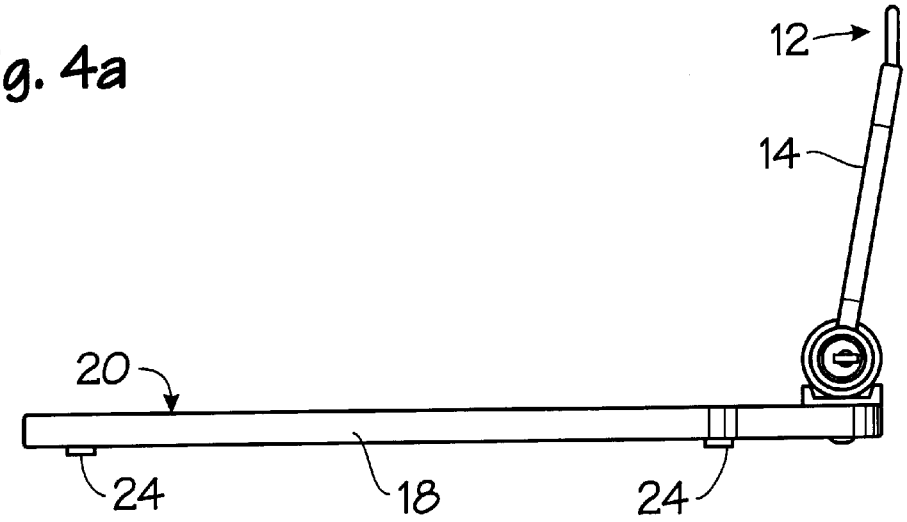
Figure 5:
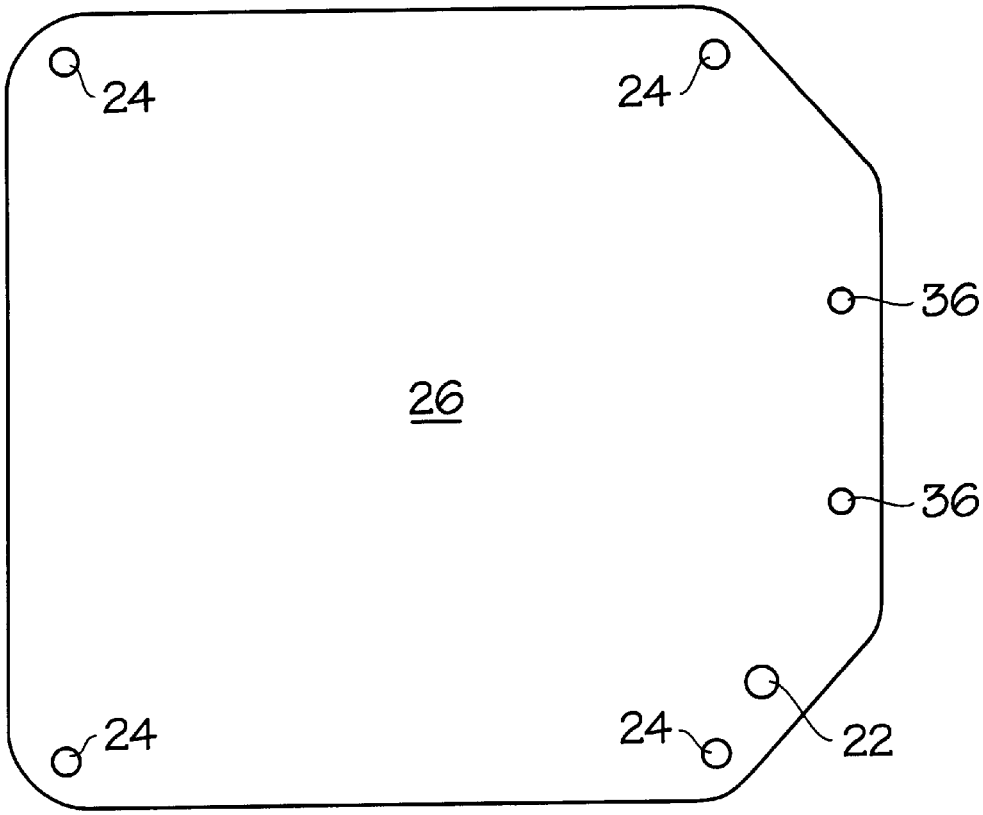
FIG. 5 is a bottom view of the security device.

FIGS. 1, 3*a* and 3*b* illustrate the preferred embodiment of the invention denoted generally with reference numeral 10 and shown in its locked position. FIGS. 2, 4*a* and 4*b* show the security device 10 in its unlocked/open position. In general, the device 10 provides a retainer 12 through which the LCD display panel of a laptop computer or similar device is positionable such that when the security device 10 is in it locked position, the computer cannot be removed without at least damaging the display. The retainer 12 itself acts as an enclosure for the display. When the word "enclosure" is used in this application with respect to the function of the retainer, it means that the retainer provides a barrier at the front, sides and rear of the display sufficiently so as to prevent the display from being removed from the retainer in respective frontward, sideward (or lateral) and rearward directions. The retainer 12 is movable into and out of its operative position by way of a support 14 which is attached via a rotating or pivoting mechanism to mounting structure 16. The mounting structure 16 is rigidly attached to a base or mini-table 18 which provides a surface 20 on which the computer rests. The mounting structure 16 could be attached directly to a substantially immovable s such as a desk top, however, this would require drilling holes or otherwise altering the desk which may not be desirable. The table 18 is sufficiently small such that it can easily rest on most desktops yet is also sufficiently large so as not to be able to be easily concealed under clothing or to be fitted within most briefcases. While the size of the mini-table 18 and the appearance of the security device securing the laptop computer thereto should act as a sufficient deterrent for the majority of potential snatch-and-grab theft situations, for added security, a cable attachment hole 22 may be provided in the mini-table 18 to which a locking cable can be secured, if desired. The table 18 may be made from any suitable material such as metal, plastic, wood, or composite and finished as appropriate for the material and the purpose for which it will be used. Rubber or felt foot pads 24 can be provided on the bottom 26 of the table 18 (see FIG. 5) to prevent damage to the desktop or other surface on which the table 18 might rest.

The mounting structure 16 consists generally an outer cylinder 30 which is rigidly attachable to table 18. An inner cylinder 28, which is longer than the outer cylinder 30, is closely fitted but sized so as to be rotatable within the outer cylinder 30 and has first and second ends 28*a*,28*b* to which are each attached one of a pair of arms 32 that form part of support 14. Thus, the support 14 and, hence, the retainer 12 can be moved or pivoted from the open and unlocked position shown in FIGS. 4*a* and 4*b* to the closed and locked position shown in FIGS. 3*a* and 3*b*. Preferably, the inner and outer cylinders 28,30 are made from high strength steel tubing.

Figure 6A:
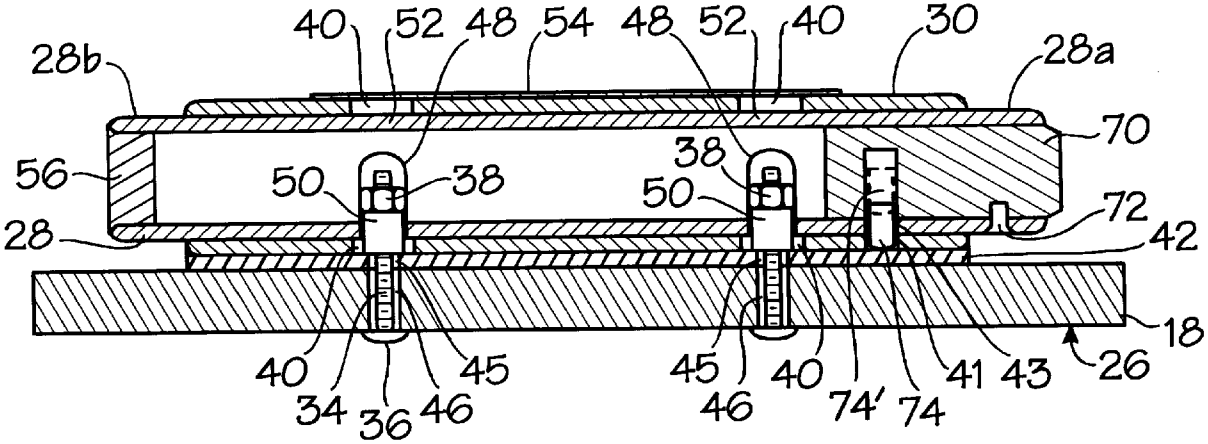
FIG. 6*a* is a front elevational view shown in cross-section along the lines VI*a*—VI*a* of FIG. 3*a* and enlarged in scales compared with FIG. 3.
Figure 7A:
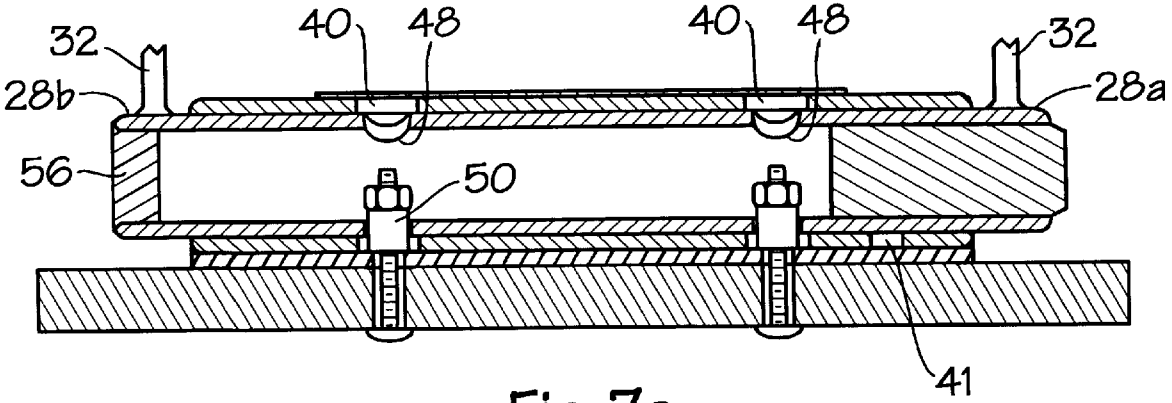
FIG. 7*a* is a front elevational view shown in cross-section along the lines VII*a*—VII*a* of FIG. 4*a* and enlarged in scale as compared with FIG. 4.

Details of the relationship between the inner and outer cylinders and the manner by which the outer cylinder is attached to the table 18 are shown in FIGS. 6*a,* 6*b,* 7*a* and 7*b*. It is important that the attachment be substantially capable of avoiding ready detachment by a would-be-thief. Depending on the materials used, the attachment can be permanent such as by welding. Preferably, however, the attachment is by means of fasteners whose unfastening elements are inaccessible when the security device 10 is in its locked position. As shown in FIGS. 6*a,* 6*b,* 7*a* and 7*b,* the fasteners are preferably carriage bolts 34, which have smooth, rounded heads 36 with no means evident (such as screwdriver slots) for their unfastening, and associated nuts 38.

Outer cylinder 30 has two spaced-apart pairs of parallel, transverse round holes 40 provided therein. A deadbolt hole 41 is provided in axial alignment with the lower two holes 40. Due to the instability around cylinder has when in contact with a flat surface, mounting structure 16 also includes a C-channel on which the outer cylinder 30 can be stably supported. The outer cylinder 30 is welded or otherwise permanently affixed to the C-channel 42 such that the pairs of holes 40 are each aligned vertically. A pair of spaced-apart holes 45 are provided in C-channel which are in registration with the holes 40 of the outer cylinder 30. The C-channel 42 provides a bottom flat surface 44 by which outer cylinder 30 can be attached in a stable manner to the upper surface 20 of the table 18. A pair of holes 46 are also provided in table 18 which coincide with the holes 45 of the C-channel.

The inner cylinder 28 is provided with a pair of slots 48 which are spaced-apart (centre to centre) the same distance as the pairs of holes 40 in the outer cylinder 30 and the holes 45 in the C-channel. Slots 48 extend approximately three quarters of the circumference of the inner cylinder 28. Because the arms 32 of support 14 are rigidly affixed such as by welding to the ends 28*a,*28*b* of the inner cylinder 28, at least one of the arms 32 will have to be welded after the inner cylinder 28 is positioned within the outer cylinder 30. A hole 43 is also provided which lies at a corresponding axial location with deadbolt hole 41.

Figure 7B:
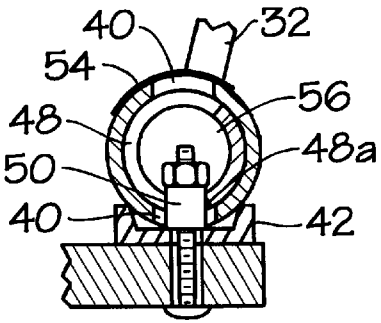
FIG. 7*b* is a side elevational view shown in cross-section along the lines VII*b*—VII*b* of FIG. 4*a* and enlarged in scale as compared with FIG. 4.

In order to attach mounting structure 16 to the table 18, the holes 45 of the C-channel are aligned with holes 46 in the table 18. The retainer 12, support 14 and inner cylinder 28 are rotated to the substantially upright position as shown in FIGS. 4*a,* 4*b,* 7*a* and 7*b,* if they are not already in this position, such that both holes 40 of each pair are in registration with a respective slot 48. Carriage bolts 34 are then inserted through holes 46 in the bottom 26 of table 18. With the access provided via the registration of holes 40 in the outer cylinder 30 with the slots 48 in the inner cylinder 28, bushings 50 are placed on carriage bolts 34 followed by nuts 38. Bushings 50 are of greater diameter than the holes 45 in the C-channel 42 so that by tightening nuts 38, the bushings 50 and the bolt heads 36 compress the C-channel 42 to the table 18. The bushing 50 provides a bearing surface for the sides of the slot 48 so that the inner cylinder 28 can be readily rotated but not moved axially relative to the outer cylinder 30. Conveniently, and 48*a* of slot 48 (see FIG. 7*b*) can be positioned to provide a stop for the rotation of them cylinder 28 such that the retainer 12 is past top dead centre, thereby enabling a stable open/locked position. The actual circumferential lent of the slots 48 is preferably optimized between the shortest possible, so that the inner cylinder 28 is not overly weakened, and sufficiently long so as to ensure access can be had to the nuts 38 through upper holes 40, as shown in FIG. 7*b*. The upper holes 40 in the outer cylinder 30 are of sufficient diameter to permit a tool such as the socket of a socket wrench (not shown) to be inserted therein to thereby enable tightening and unfastening of nuts 38.

When the retainer 12, support 14 and inner cylinder 28 are rotated toward a more horizontal position as shown in FIGS. 3*a,* 3*b,* 6*a* and 6*b,* the slots 48 move out of registration with the upper holes 40 in the outer cylinder 30. Access to the "unfastening" elements, i.e. nuts 38, through upper holes 40 is prevented because portions 52 of the inner cylinder 28, diametrically opposed to slots 48, underlie the upper holes 40. For aesthetic purposes, a thin metal plate 54 or label could be applied over the upper holes 40 (see also FIG. 3*a*) to prevent them showing and to prevent visual access to the fastening system when the device 10 is in its open/unlocked position. Although also not necessary (because even with a tool it would not be possible to unfasten either or both nuts 38 through the relatively small inner diameter of the end 28*b* of inner cylinder 28), a plug 56 can be inserted and fixed in end 28*b* or the end 28*b* can be closed in other blown ways, again primarily for aesthetics reasons.

The security device 10 also includes a lock mechanism 68 for locking the retainer 12 in a predetermined orientation with respect to the surface 20 of the table 18. The specifics of the locking mechanism 68 are not overly important. However, the lock must be able to fix the relative positions of the inner and outer cylinders 28,30 such that the retainer 12 can be positioned in a predetermined orientation above the sure 20. In addition, it would be desirable that the lock mechanism 68 function automatically to lock the retainer 12 in this orientation without having to specifically operate the lock. The lock mechanism could take the form of an externally positioned device which when operated inserts a pin through respective holes in the outer and inner cylinders. However, in the preferred embodiment, the lock mechanism 68 includes a lock cylinder 70 which is insertable within end 28*a* of inner cylinder 28 and fixed therein by means of a set screw 72. The lock 68 has a spring-loaded deadbolt 74 operable automatically to extend through hole 43 and engage deadbolt hole 41 in outer cylinder 30 when the rotation of the inner cylinder 28 causes the deadbolt 74 to register with deadbolt hole 41. The deadbolt 74 is retractable to a position 74' shown in phantom within the lock cylinder 70 upon operation of a key (not shown) in keyhole 76 (see FIG. 8). The deadbolt 74 is of sufficient size and is made from suitable material so as to withstand the shear forces which it might encounter if an attempt was made to lift or force the retainer 12 and support 14 away from the surface 20 of the table 18 while the deadbolt 74 is engaged within hole 41 in the outer cylinder 30. It will be appreciated that the lock mechanism 68 serves a second purpose in preventing access when locked and permitting access when unlocked to the unfastening mechanisms, i.e. the nuts 38, which are contained within the in cylinder 28.

As mentioned above, the retainer 12 and support 14 are rigidly affixed to the inner cylinder 28 for movement therewith as the inner cylinder rotates within outer cylinder 30. In the preferred embodiment, the support 14 includes a pair of arm 32 which extend from the ends 28*a,*28*b* of the inner cylinder 28 in a plane which generally coincides with the longitudinal axis of the inner cylinder 28. The arms 32 diverge outwardly and provide support for the retainer 12.

Figure 8:
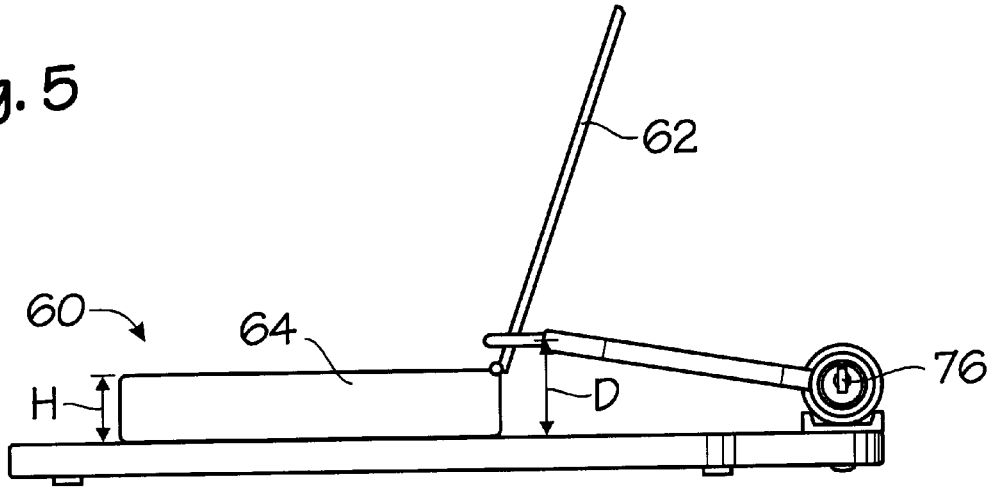
FIG. 8*a* is a side elevational view of the security device in its locked position in association with a laptop computer.
Figure 6B:
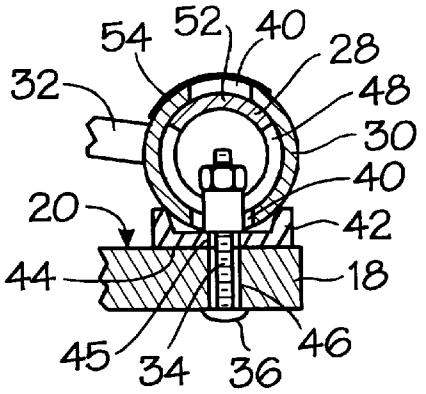
FIG. 6*b* is a side elevational view shown in cross-section along the lines VI*b*—VI*b* of FIG. 3*a* and enlarged in scale as compared with FIG. 3.
Figure 9:
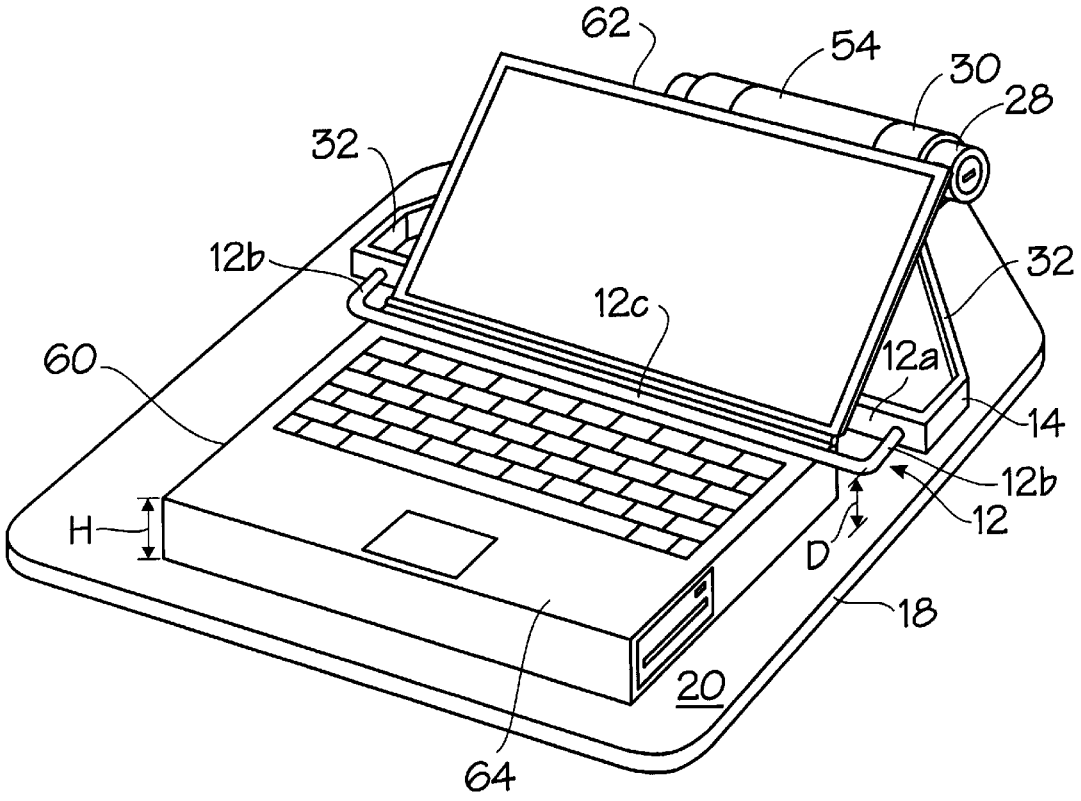
FIG. 9 is a perspective view similar to FIG. 1, but with the laptop computer secured in place.

In general, the purpose of the retainer 12 is to engage the LCD display panel 62 of a laptop computer 60 (as shown in FIGS. 8 and 9) in such a manner relative to the surface 20 that it cannot be removed or withdrawn from the device 10. The retainer 12 comprises rear, lateral and front members 12*a,* 12*b,* 12*c* which are adapted to engage the display 62 of the laptop 60 which is pivotably connected to the deck 64 of the computer 60. The purpose of the rear, lateral and front members 12*a,* 12*b,* 12*c* is to prevent the display 62 from being removed in rear, lateral and front directions when the retainer 12 is engaged therewith. The retainer 12 as shown is closed, i.e. completely surrounding the display 62, however, as will be explained hereinbelow with respect to alternate embodiment, other "open" configurations of the retaining means can be operable to ensure the display 62 cannot be maneuvered out of the retainer except by moving the retainer from its locked position. For case of manufacturing, the rear member 12*a*can be formed integrally with the arms 32 from a steel bar of rectangular cross-section, for example, which is bent into the shape as shown and welded to the ends 28*a*,28*b* of the inner cylinder. The remainder of the rear 12 may be constructed of steel rod, which has been bent at the ends to form the lateral and front retaining members 12*b*,12*c*. The lateral members 12*b* are rigidly attached to the rear member 12*a*, for example, by inserting and welding the free ends through commending holes (not shown) provided in the rear member 12*a*. Preferably, the lateral members 12*b* are spaced apart sufficiently so as to accommodate the width of most displays while the rear retaining member 12*a* is spaced apart from the front retaining members 12*c* at least the thickness of the display 62 or greater as will be explained in detail hereinbelow.

When the dice 10 is locked, the support 14 serves to maintain the retainer 12*a* distance D above the surface 20 which corresponds roughly to or is slightly greater than the thickness H of the deck 64 of the compute 60. While the retainer 12 when in the locked position is shown as being generally horizontal i.e. parallel to the surface 20, its orientation can differ so long as the spatial relationship between the front and tear members 12*c*,12*a* with respect to the surface 20 is such that the computer 60 cannot be maneuvered so as to withdraw display 62 from the space 13 inside retainer 12.

Figure 10A:
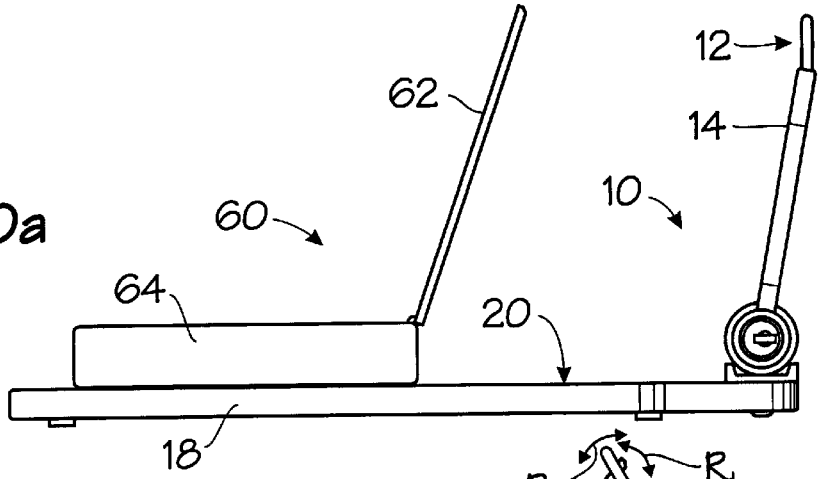
FIGS. 10*a*–10*d* are side elevations illustrating the manner in which a laptop computer can be secured with the preferred embodiment of the invention.
Figure 10B:
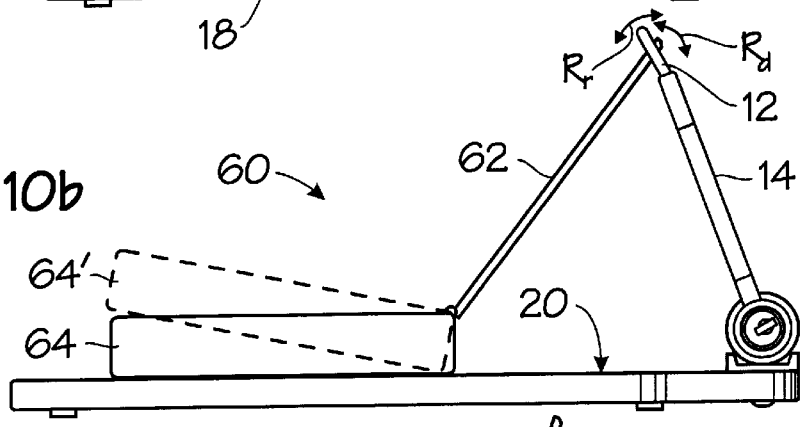

The operation of the invention is illustrated in FIGS. 10*a*–10*d*. FIG. 10*a* shows the security device 10 in its unlocked position. In this position, the retainer 12 and the support 14 obstruct a minimum of the surface 20. The laptop 60 is positioned on the surface 20 where it can be used in a normal fashion and only secured when it is left unattended or alternately, can be secured at all times. To secure the laptop 60, retainer 12 and the support 14 are pivoted towards the computer 60 in the direction of arrow $R_r$ and the display 62 is inserted through the space 13 in retainer 12 as shown in FIG. 10*b*. Some manipulation of the computer 60 and/or its position may be required to ensure smooth engagement. Depending on the specific laptop 60, the display 62 may be sufficiently pivotable but where it is not, the deck 64 of the computer 60 may be lifted slightly as shown in phantom at 64' in FIG. 10*b*. Preferably, however, the sizes of the various elements that constitute the device 10 are made such that the paths of rotation of the front and rear retaining members 12*c*,12*a*, which depends on the distance of each to the longitudinal axis of the inner cylinder 28, permit the retainer 12 to are down over the display 62 either without movement of the display 62 or with only minor pivoting movement thereof in the directions of arrows $R_d$.

Figure 10C:
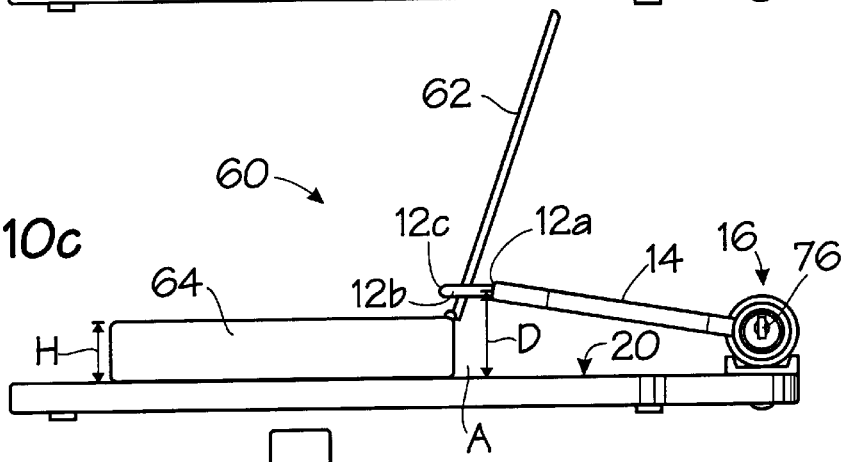

The retainer 12 and support 14 and, if applicable, the display 62, are continued to be pivoted ($R_r$,$R_d$) until the deadbolt 74 registers with the deadbolt hole 41 (see FIG. 6*a*) and is automatically actuated so that the device 10 is immovably locked in the position shown in FIG. 10*c*. In the locked position, the front retaining member 12*c* is disposed at a distance D above the surface 20, which is at or just slightly above the height H of the deck 64. The support 14 extends from the inner cylinder 28 a predetermined length. This length is primarily a function of the swing arcs of the front and rear retaining members 12*c*,12*a* with respect to the longitudinal axis of the inner cylinder 28 which will enable the retainer 12 to engage with the display 62 as explained above and as shown in FIG. 10*b*. Having the support 14 extend above the surface 20 to the retainer 12 advantageously results in an unobstructed area A located between the deck 64 and the mounting structure 16 for accommodation of any cabling for modem phone lines, printer and other peripheral communication, power cords, etc.

Figure 10D:
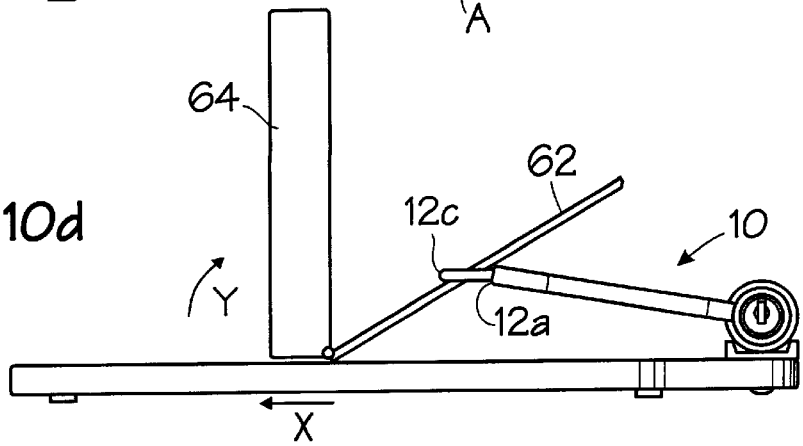

As indicated above, the front and rear retaining members 12*c*,12*a* are spaced apart sufficiently to enable the display 62 to be inserted within the retainer 12 without excessive contact. As additional protection against abrasion, the retainer 12 could be coated with a rubberized material or rubber bumpers (not shown) could be provided. The wider the spacing 13 between the front and rear retaining members 12*c*,12*a*, the easier the engagement step, the greater the ability to accommodate different types and sizes of laptops, and the greater the ability to let the user adjust the angle of the display 62 when the security device 10 is in place in its locked position. The spacing between the front and rear retaining members 12*c*,12*a*, however, must not be sufficiently wide so as to enable the display 62 from being slid out, i.e. withdrawn from, the retainer 12. In general, the relative positions of the rear retaining member 12*a* and front retaining member 12*c* and the surface 20 which will be operable to prevent withdrawal of the display 62 from the retainer 12 depends on size and configuration of the computer 60, the thickness of the display 62, and the shapes of the front and rear retaining members 12*c*,12*a*. As shown in FIG. 10*d*, there is illustrated what would happen if the computer 60 were attempted to be removed from the security device 10. Due to the positioning of the it retaining member 12*c* at or slightly above the height of the deck 64, it is not possible to remove the laptop 60 vertically. While it is possible that a combination of movements such as is shown by arrows X and Y may enable the deck 64 to be removed from out under the front retaining member 12*c*, the spacing of the front retaining member 12*c* in relation to the surface 20 along with the position of the rear retaining member 12*a* with retainer to the front retaining member 12*c* do not permit the display 62 to be withdrawn from the retainer 12 without causing serious (and costly) damage to the display 62, which would significantly diminish the value of the stolen computer.

A generally reverse procedure (i.e. from FIGS. 10*c* to 10*a*) is used to remove the computer 60 from the device 10. The user simply disengages the lock by operating the key in keyhole 76, and then rotates retainer 12 and support 14 upwardly and rearwardly while the display 62 is pivoted rearwardly to remove the display 62 from the retainer 12.

Figure 11:
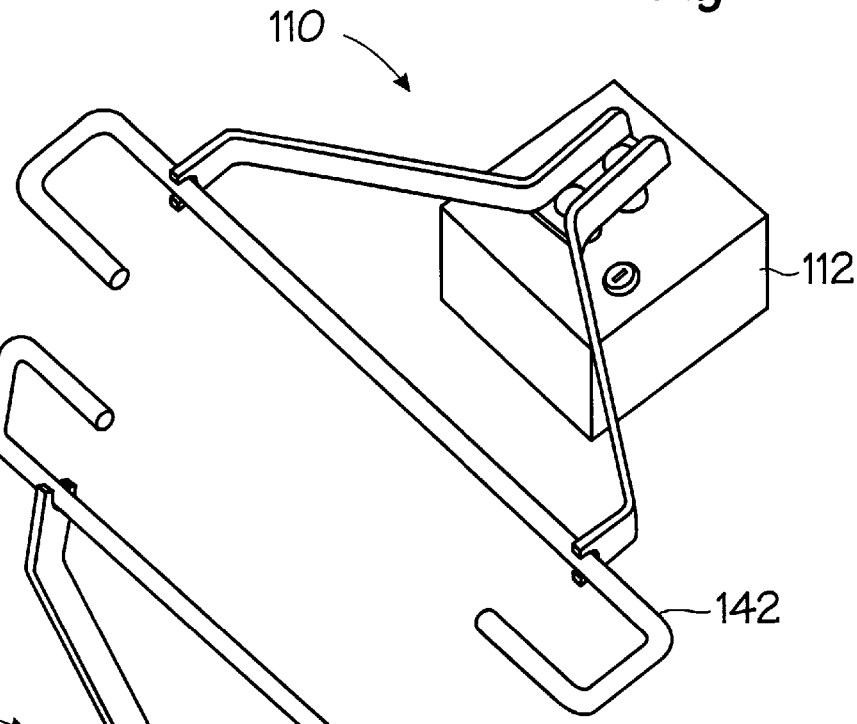
FIG. 11 is a perspective view of a second embodiment of the computer security apparatus of the present invention in its closed and locked position without the laptop computer.
Figure 12:
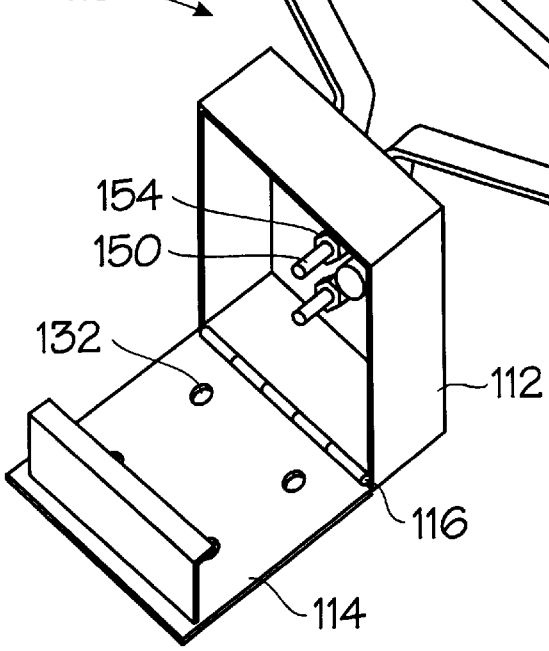
FIG. 12 is a perspective view of the computer security apparatus shown in FIG. 11, in its open and unlocked position.

In general, the requisite spatial relationship between the front and rear retaining members 12*c*,12*b* and the surface 20 when the retainer 12 is in its locked position which will prevent removal of the display 62 and, hence computer 60, maybe provided in a number of different ways. To illustrate this principle further, FIGS. 11 and 12 illustrate a second embodiment of the invention denoted generally with reference numeral 110 and shown in its locked and unlocked positions, respectively. In general, the device 110 comprises a housing 112 hingedly attached to a mounting structure or base 114 by way of a pivot or hinge 116. Details of the device 110 are illustrated in FIGS. 13 to 16.

In this embodiment, base 114 is adapted to be mounted on a substantially immovable surface 118 by means of suitable 120. The housing 112 provides a space 122 in which elements needed for the disassembly of the apparatus or removal of the apparatus from the surface 18 are enclosed and secured. Both the housing 112 and the base 114 can be fabricated from fairly heavy gauge sheet steel or steel plate which has been cut and welded and pivotably fastened together with an internal hinge 116.

Figures 13, 14:
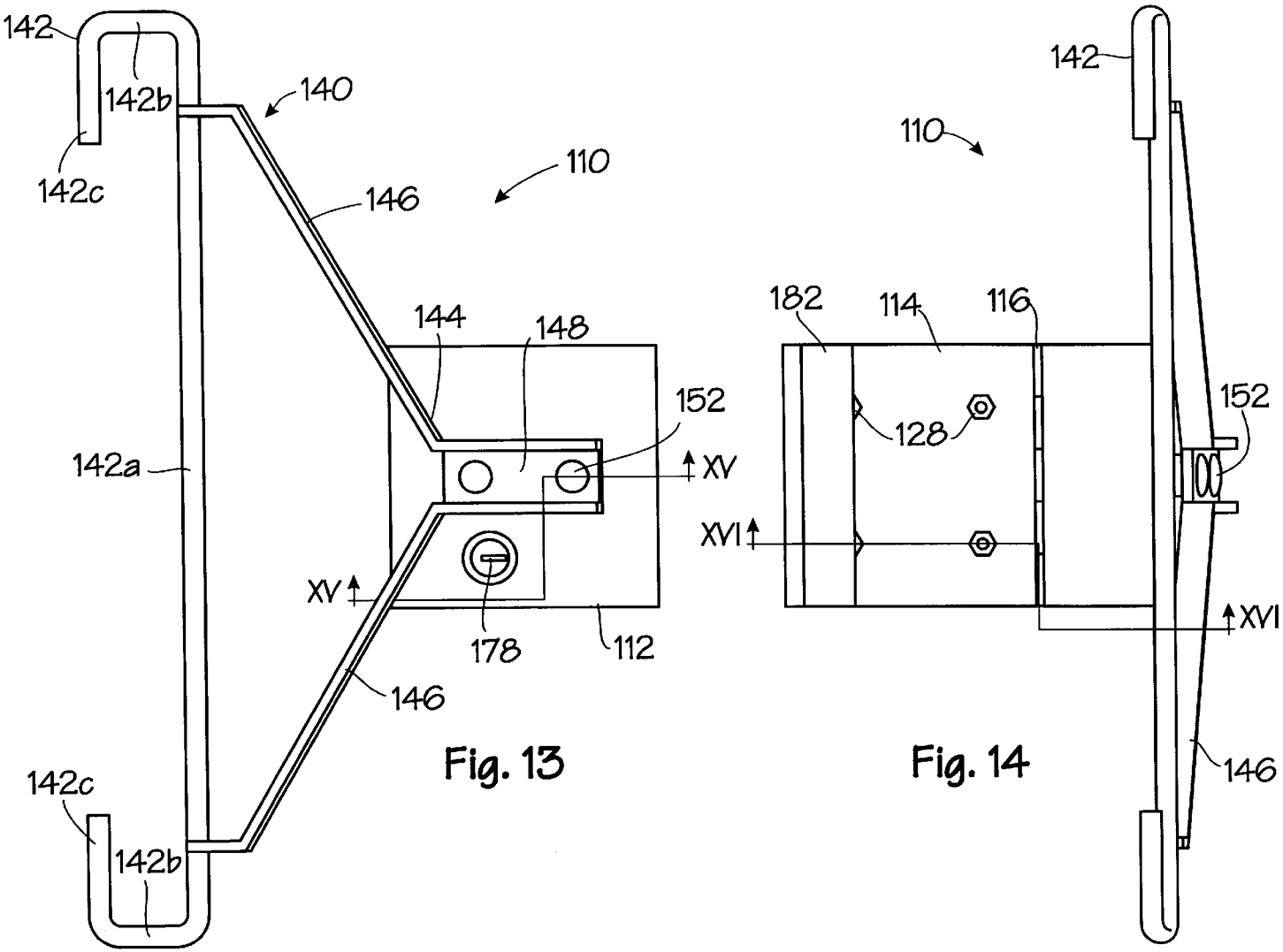
FIG. 13 is a plan view of the computer security apparatus of FIG. 1.
FIG. 14 is a plan view of the computer security apparatus as shown in FIG. 12.
Figure 16:
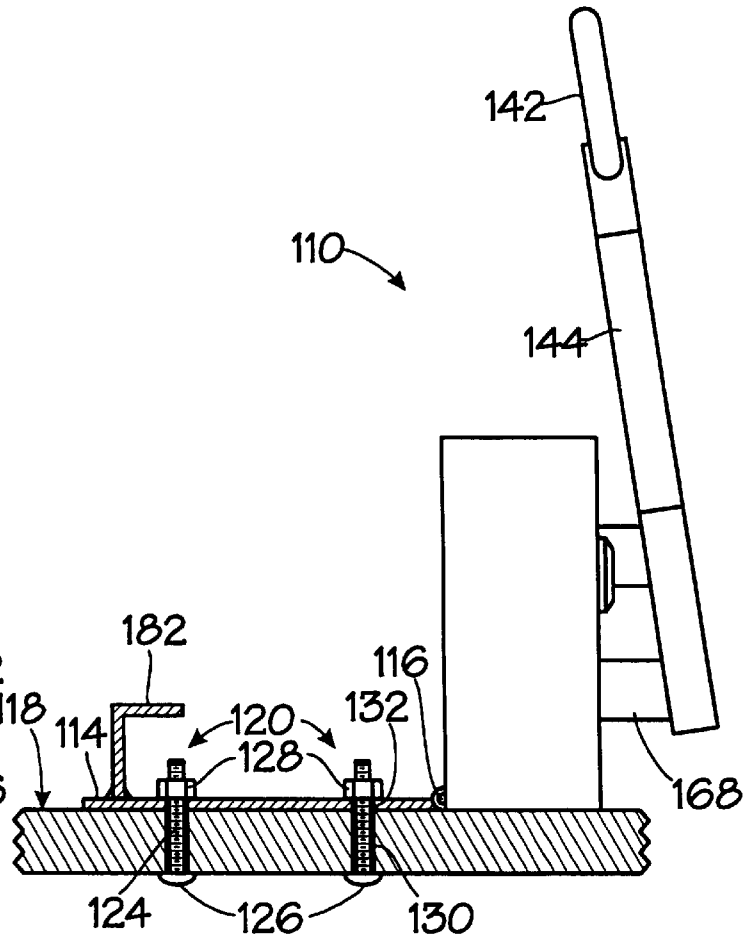
FIG. 16 is a side elevational view of the computer security apparatus as shown in FIG. 12 bolted to a desktop showing the base and desktop in cross-section as seen along lines XVI—XVI of FIG. 14.
Figure 15:
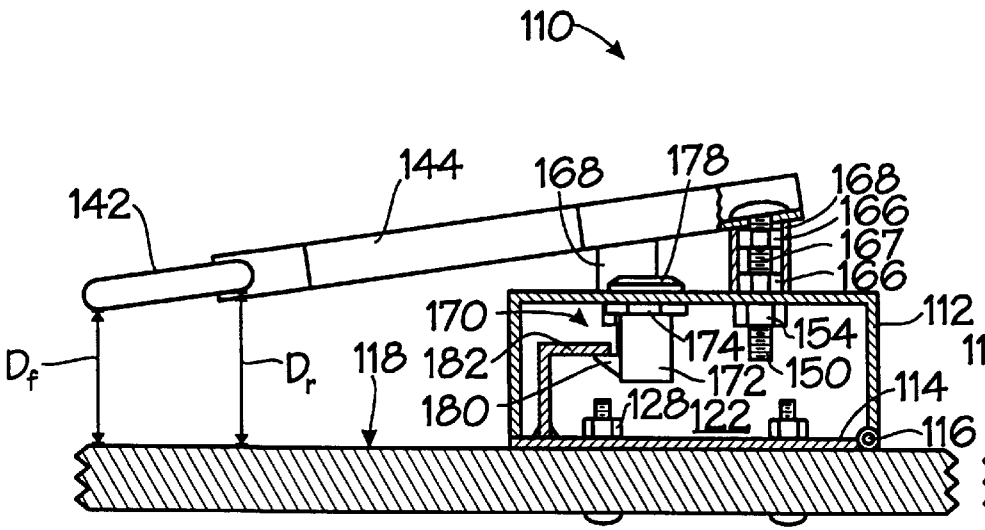
FIG. 15 is a side elevational view of the computer security apparatus of FIG. 11 bolted to a desktop showing the housing and desktop in cross-section as seen along lines XV—XV of FIG. 13.

As with the first embodiment, the fastens used should have the "unfastening" element thereof inaccessible at least when the device 110 is in its locked position. In the second embodiment, the fastens are disposed within the housing 112 to prevent removal of the entire security apparatus 110 from the surface 118. For purposes of illustration, the second embodiment described herein presupposes the surface 118 to be horizontal and of a limited thickness so as to permit through-fasteners to be used. As shown in FIGS. 14 to 16, the base fasteners 120 comprise carriage bolts 124, which have smooth, rounded heads 126 with no means evident (such as screwdriver slots) for their unfastening and associated nuts 128.

Holes 130 may be pre-drilled in surface 118 using apertures 132 (see FIG. 12)in base 114 as a template. The carriage bolts 124 are then inserted upwards through holes 130, through the corresponding apertures 132 and then bolts 124 are fastened with nuts 128, thereby securing base 114 to surface 118. It will be appreciated that where desired, the base fasteners could be of the "blind-type", such as for example screws, which are screwed directly into the surface 118 through the apertures 132 in the base. As with the through-type fastener mentioned above, the means by which the screws are unfastened, i.e. their heads, would be contained within the space 122 so that access thereto is prevented when the housing 112 is locked in place on base 114 as shown in FIG. 15.

A structure 140 for engaging a laptop computer and securing it to the surface 118 is rigidly affixed to the housing 112 for movement therewith as the housing 112 pivots about the hinge 116. The structure 140 comprises in general are 142 and a support member 144 therefor. In the embodiment illustrated, the support member 144 is fabricated in a Y-shape having a pair of arms 146 which diverge from an attachment plate 148. The arms 146 may be made from steel bars which have been bent and welded to the attachment plate 128 formed of steel plate, bar or the like. At their ends distal the attachment plate 148, the arms 146 are rigidly connected to the retainer 142, such as by welding. The supporting member is rigidly fastened to the housing 112 by means of a pair of carriage bolts 150 which are inserted through apertures in the attachment plate 148 and corresponding apertures in the housing 112 and fastened by nuts 154. As with fasteners 120 which fasten the base 114 to the surface 118, the smooth heads 152 of carriage bolts 150 are disposed externally of the housing 112, while the "unfastening elements" or nuts 154 therefor are disposed within the housing 112 to present their removal when the housing 112 is locked to the base 114.

Figure 17:
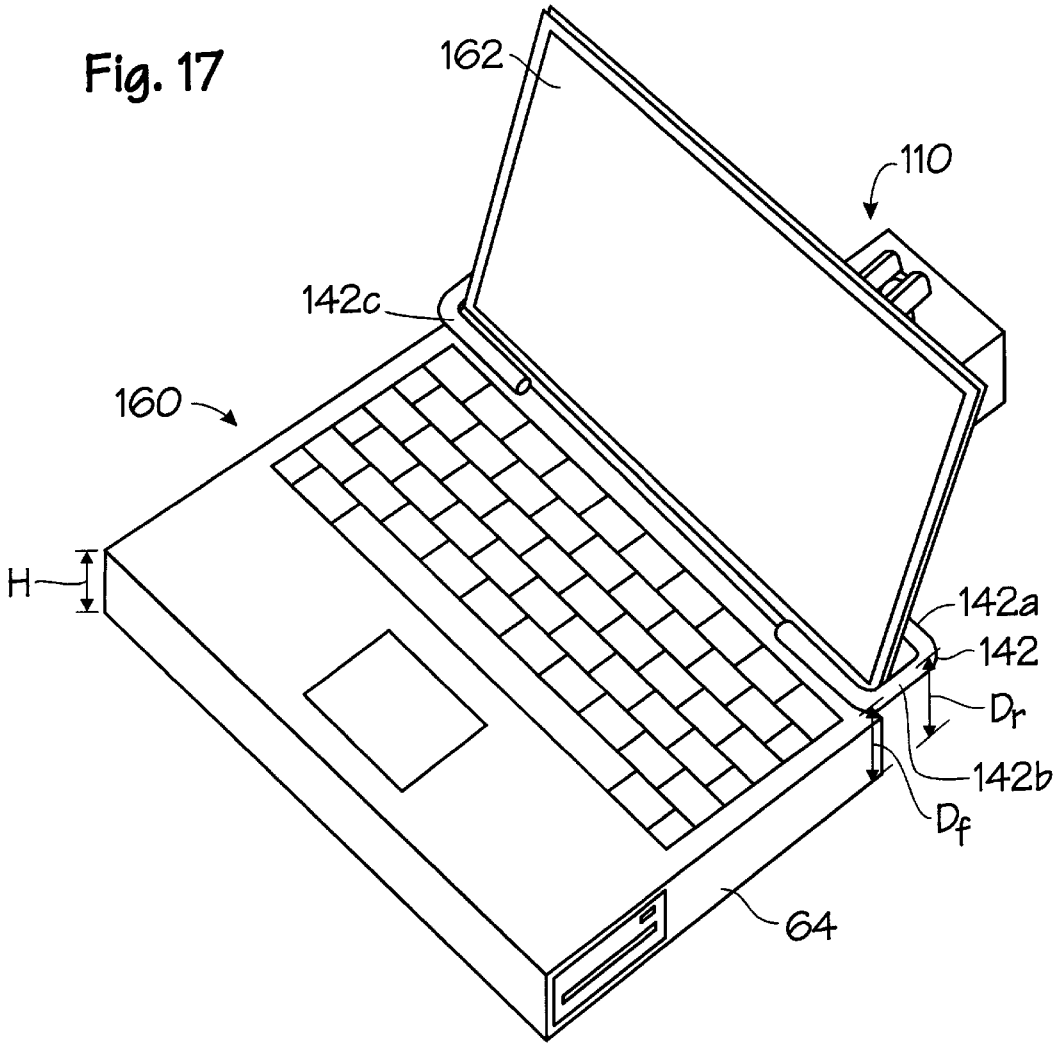
FIG. 17 is a view similar to that shown in FIG. 11, but with the laptop computer secured in place.

In general, the purpose of the retainer 142 is to engage a laptop computer 160 (as shown in FIG. 17) in such a manner relative to the surface 118 that it cannot be removed or withdrawn from the device 110. To illustrate an "open" form of retainer, the retainer 142 comprises rear, lateral and front members 142*a,* 142*b,*142*c* which are adapted to engage the display 162 of laptop 160 which is pivotably connected to the deck 164 of the computer 160. While the retainer 142 could be closed, such as the retainer 12 shown in FIG. 1, the C-shaped configuration is advantageous as it reduces the chances that a portion thereof will obstruct view of the display 62. However, the advantage of a closed retainer configuration is its inherent strength and accordingly, the C-shaped retainer 142 would have to be constructed with that in mind. Conveniently, the C-shaped retainer 142 can be constructed of steel rod which has been bent at the ends to form the lateral and front retaining members 142*b,* 142*c*. The relative spacing between the lateral members 142*b* and between the front and rear members 142*c,*142*a* involve generally the same considerations as the respective spacings of retainer 12, while the space between the front retaining members 142*c* is such that a display of a minimum anticipated width cannot be maneuvered out of the retaining member 142 through the space.

The support member 140 supports the retainer 142, and in particular the front retaining members 142*c,* a distance $D_f$ above the surface 118 which corresponds generally to the thickness H of the deck 164 of the computer 160. While it has been found that spacing of about 1½ inches between the front and rear retainer members which are each spaced a distance of about 2 inches above the surface when in the locked position is satisfactory to accommodate the vast majority of laptop computers currently available and prevent their removal, some adjustability would enable the security device to be used with a wider variety of computer devices, such as palmtops, personal electronic organizers, and the like. In this regard, the second embodiment is provided with custom adjustability in the connection of the support member 144 to the housing 112. In this way, the distance $D_f$ that the front retainer members 142*c* is positioned above the surface 118 can be fine-tuned to be at or just slightly above the height of the deck 164 as is shows in FIG. 17. Adjustability can also be provided, for example, by varying the effective length of the fasteners 150 used to affix the attachment plate 148 of the support member 144 to the housing 112. In the second embodiment, a pair of height adjusting nuts 166 are threaded onto the length of the shank portion 167 of each fastener 150 between the attachment plate 148 and the housing 112. A sleeve 168 is positioned over the nuts 166 to both conceal them and prevent access thereto. Alternately, spacers or a plurality of washers (not shown), for example, could be used to maintain the support member 144, and hence, the retainer 142, in a predetermined position. Once the position of the retainer 142 is adjusted appropriately for the specific computer, the nuts 154 are then threaded onto the fasteners 150 and tightened against the inside of the housing 112. As shown, the effective length given the shank portion of the fastener proximal the retaining member can be made shorter than the other, resulting in the rear retaining member 142*a* being disposed higher above the surface 118 than the front retaining members 142*c*. The advantage of this arrangement is explained hereinbelow.

A locking mechanism 170 (see FIG. 15) is provided to control access to the fastening elements 128,154 within the space 122 and to enable the retainer 142 to be lockingly engaged and disengaged from the display 162. The specifics of the lock mechanism 170 are not overly important and any arrangement suitable for locking the housing 112 to the base 114 could be used. The locking mechanism provided in a given configuration is generally a function of the level of convenience and security required. Although not to be considered limiting, typical locks could include a cam lock, push button lock, spring loaded latch type, or could even consist of a an arrangement consisting of a hasp that extends from the base and protrudes through the housing and to which a padlock is attached. For the purposes of illustration, a lock mechanism 170 having a lock cylinder 172 is secured to the housing 112 my means of lock nut 174, again disposed within space 122. A pick-resistant, keyed lock operator 178 is used to retract a latch 180 provided in the lock cylinder 172. Latch 180 is spring loaded to permit the latch to automatically engage and lock with lock flange 182 as the housing 112 is closed toward the base 114. Since the support member 144 and retainer 142 are substantially rigidly affixed to the housing 112, when the housing 112 is locked, so are their positions.

Figure 18:
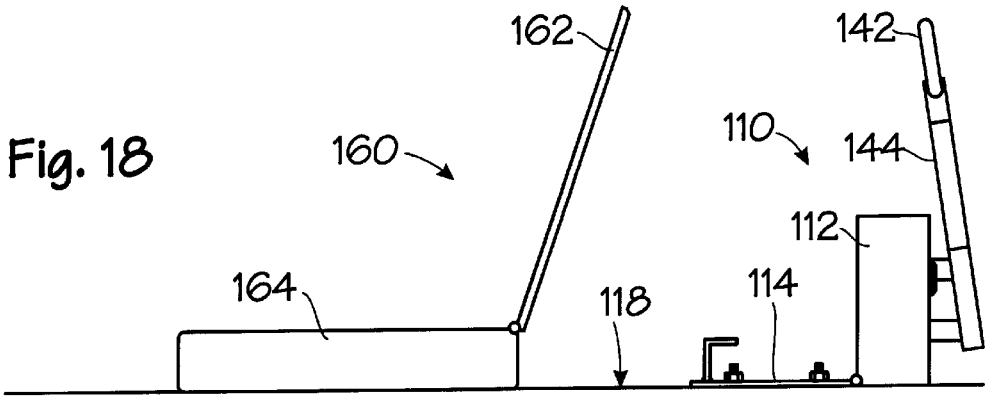
FIGS. 18 to 21 are side elevations illustrating the manner in which a laptop computer can be secured with the FIGS. 11 through 17 embodiment of the invention.
Figure 19:
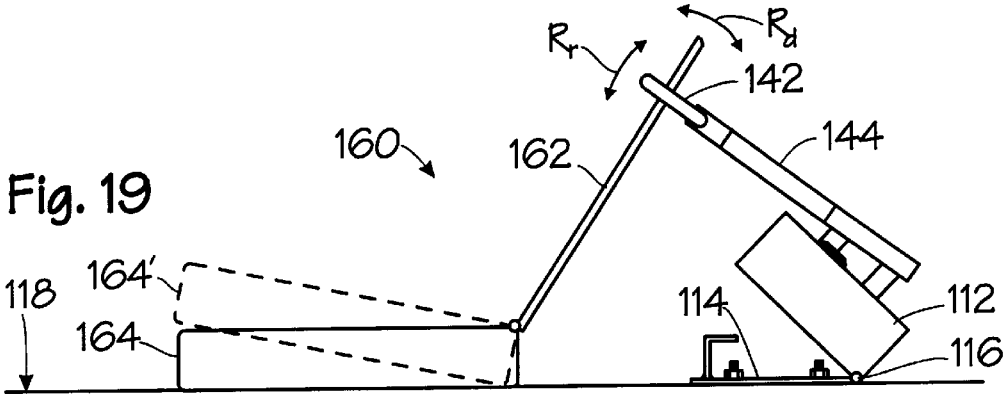

The operation of the second embodiment is illustrated in FIGS. 18 to 21. FIG. 18 shows the security device 110 in its unlocked position with its base 114 being fastened to a surface 118. In this position, the retainer 142 and the support member 144 obstruct a minimum of the surface 118. The laptop 160 is positioned on the surface 118 where it can be used in a normal fashion and only secured when it is left unattended or alternately, can be secured at all times. To secure the laptop 160, retainer 142, the support member 144 and the housing 112 are pivoted towards the computer 160 in the direction of arrow $R_r$ and the display 162 is inserted through retainer 142 as shown in FIG. 19. Some manipulation of the computer 160 and/or its position may be required to ensure smooth engagement. Depending on the specific laptop 160, the display 162 may be sufficiently pivotable but where it is not, the deck 164 of the computer 160 may be lifted slightly as shown in phantom at 164' in FIG. 19. Preferably, however, the sizes of the various elements that constitute the device 110 are made such that the paths of rotation of the front and rear retaining members 142*c*,142*a*, which depends on the distance of each to the hinge 116, permit the retainer 142 to are down over the display 162 either without movement of the display 162 or with only minor pivoting movement thereof in the directions of arrows $R_d$.

Figure 20:
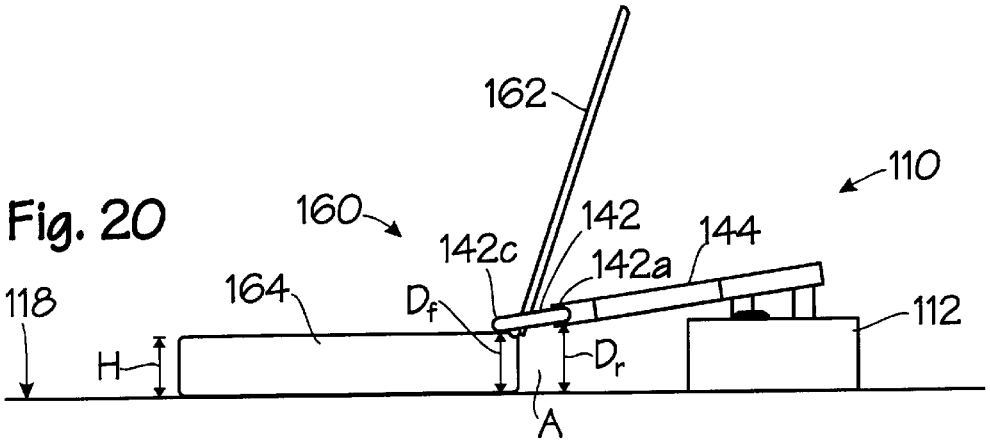
Figure 21:
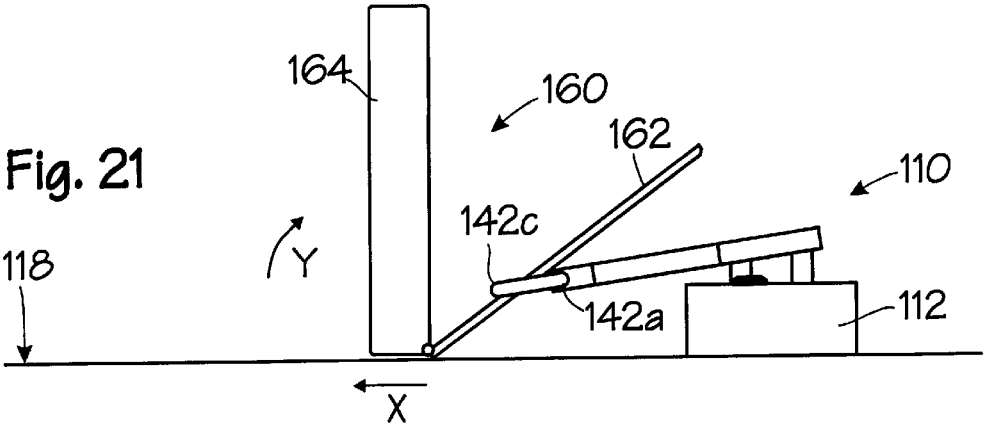

The retainer 142, supporting member 144, housing 112 and, if applicable, the display 162, are continued to be pivoted ($R_r$,$R_d$) until the housing 112 closes over the base 114 as illustrated in FIG. 20 and the lock mechanism 170 is actuated. In the locked position, the front retaining member 142*c* is disposed at a distance $D_f$ above the surface I 18, which is at or just slightly above the height H of the deck 164. As indicated above, the front and rear retaining members 142*c*,142*a* are spaced apart sufficiently to enable the display 162 to be inserted within the retainer 142 without excessive contact. The wider the spacing between the front and rear retaining members 142*c*,142*a*, the easier the engagement step, the greater the ability to accommodate different types and sizes of laptops, and the greater the ability to let the user adjust the angle of the display 162 when the security device 110 is in place in its locked position. The spacing between the front and rear retaining members 142*c*, 142*a*, however, must not be sufficiently wide so as to enable the display 162 (and particularly a display of minimum width) to be angled out of the retainer 142 through the space between the front retainer members 142*c*. The distance between the front and rear retainer members 142*c*,142*a* must also be sufficiently small to prevent the display 162 from being slid out i.e. withdrawn from, the retainer 142. In general, the relative position of the rear retaining member 142*a* with respect to the front retaining member 142*c*, when in the locked position, is dependent on the relative position of the front retaining member 142*c* and the surface, as well as the size and configuration of the computer, the thickness of the display, and the shapes of the front and rear retaining members 142*c*,142*a*. As shown in FIG. 21, there is illustrated what would happen if the computer 160 were attempted to be removed from the security device 110. Due to the positioning of the front retaining member 142*c* at or slightly above the height of the deck 164, it is not possible to remove the laptop 160 vertically. While it is possible that a combination of movements such as is shown by arrows X and Y may enable the deck 164 to be removed from out under the front retaining members 142*c*, the spacing of the front retaining members 142*c* in relation to the surface 118 along with the position of the rear retaining member 142*a* with respect to the front retaining members 142*c* do not permit the display 162 to be withdrawn from the retainer 142 without causing serious (and costly) damage to the display 162, which would significantly diminish the value of the stolen computer. As mentioned above, the support arm 144 can be adjustably attached to the housing 112 in such a manner that the rear retaining member 142*a* is disposed above the front retaining member 142*c*. This further limits the extent to which the display can be withdrawn from the retainer 142 (as shown in FIG. 21) without overly restricting the width of the opening (i.e. the space between the front and rear retaining members 142*c*,142*a*) which, as mentioned before, would detract from the engageability of the retaining 142 with the display 162 as well as potentially limit the adjustability of the angle of the display 162 when the computer 160 is in use with the device 110 in its locked position.

As can be seen in FIG. 20, the supporting member 144 extends from the housing 112 a predetermined length. This length is primarily a function of the swing arcs of the front and rear retaining members 142*c*,142*a* with respect to the hinge 116 which will enable the retainer to engage with the display as explained above and as shown in FIG. 19. Having the supporting member 144 extend above the housing 112 to the retainer 142 advantageously results in an unobstructed area A located between the deck 164 and the housing 112 for accommodation of any cabling for modem phone lines, printer and other peripheral communication, power cords, etc.

Since it may not be desirable or feasible to attach the base 114 of the device 110 to a surface 118 such as a desk due to the need for alteration of the surface (i.e. by drilling), a variation of the invention is contemplated in which the base 114 is attached to a mini-table 186 which provides the surface 188 against which the retainer holds the computer. In this case, the device itself is not necessarily affixed to an immovable surface but rather, the mini-table 186 is made sufficiently large enough so as to be substantially incapable of being easily concealed, such as in a briefcase or under a garment. In this regard, a size of about at least 18"(457.2 mm) from front to back and about at least 16"(406.4 mm) wide should serve such a purpose. Conveniently, such a large surface 188 could be employed as the desktop as is the case with table 18 of the first embodiment FIGS. 22 to 27 illustrate this third embodiment of the invention.

Figure 22:
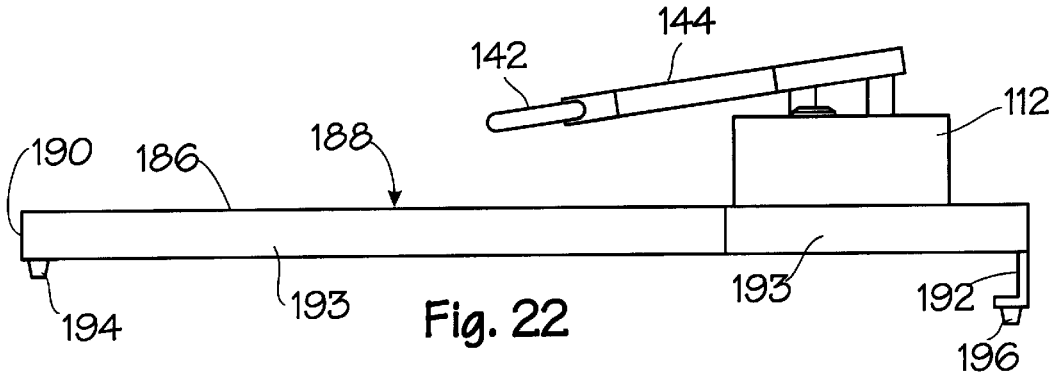
FIGS. 22 to 27 are various views illustrating another embodiment of the invention.
Figure 23:
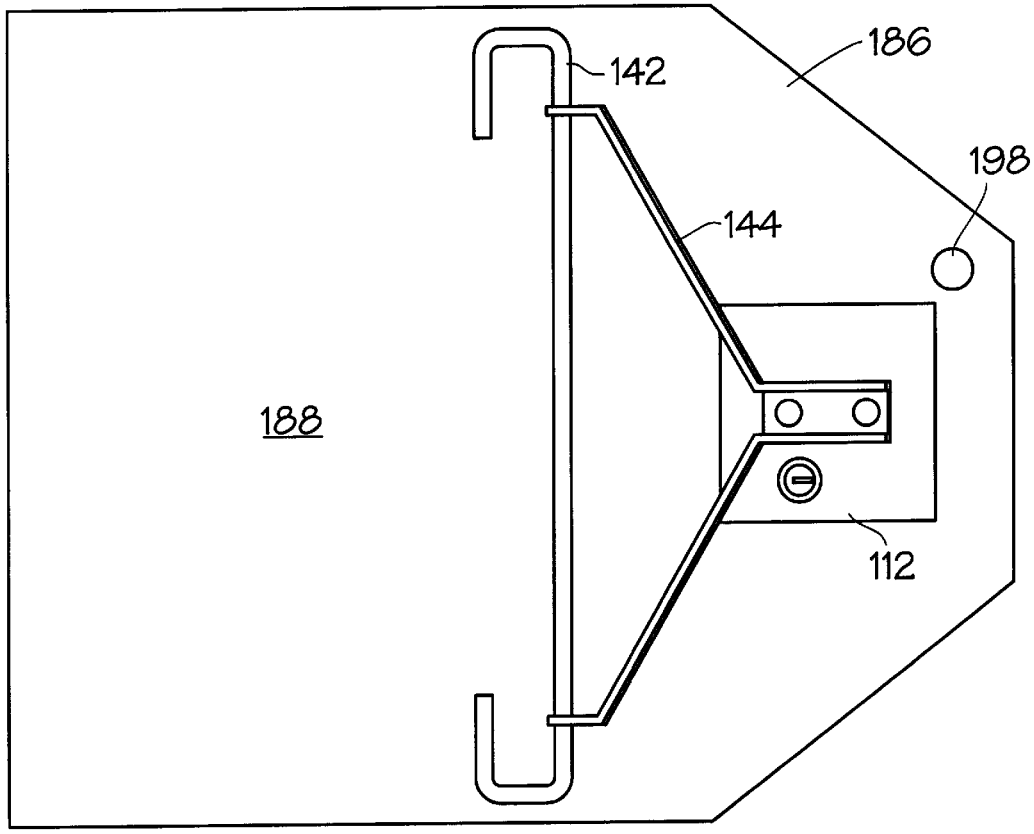
Figure 24:
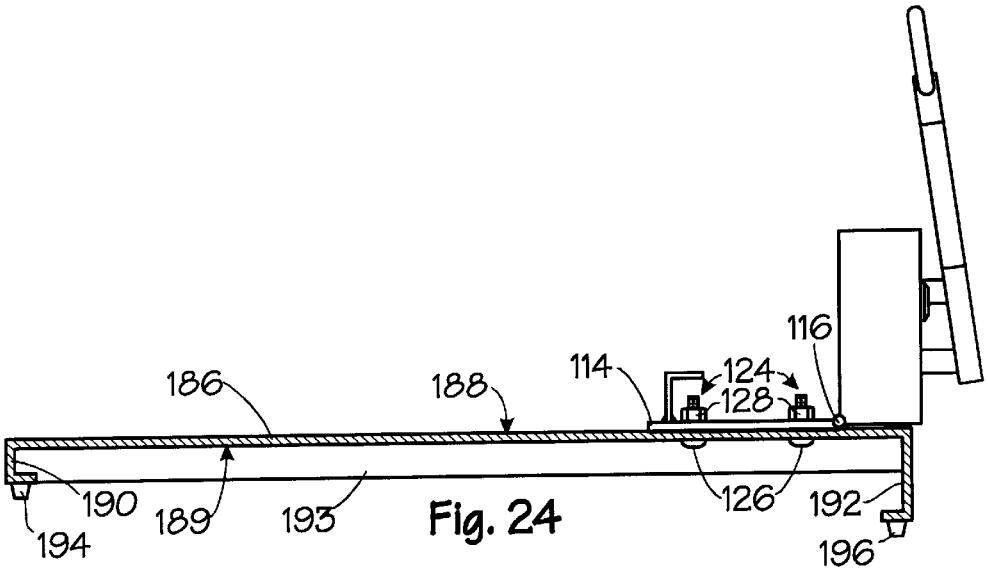
Figure 25:
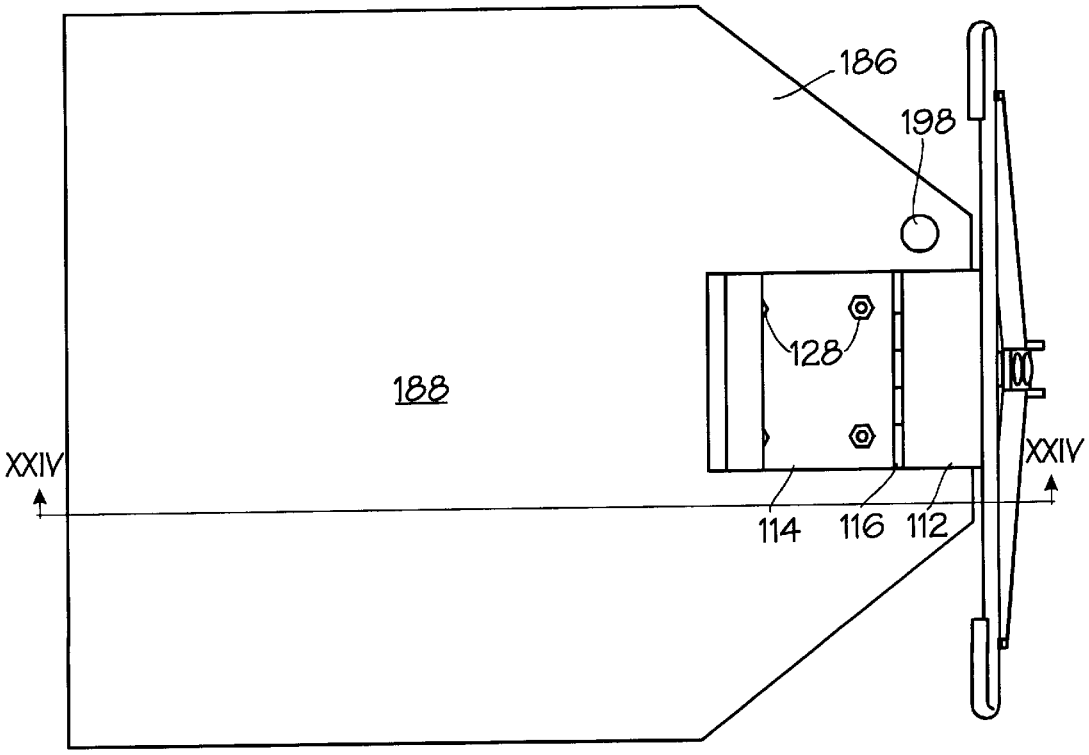
Figure 26:
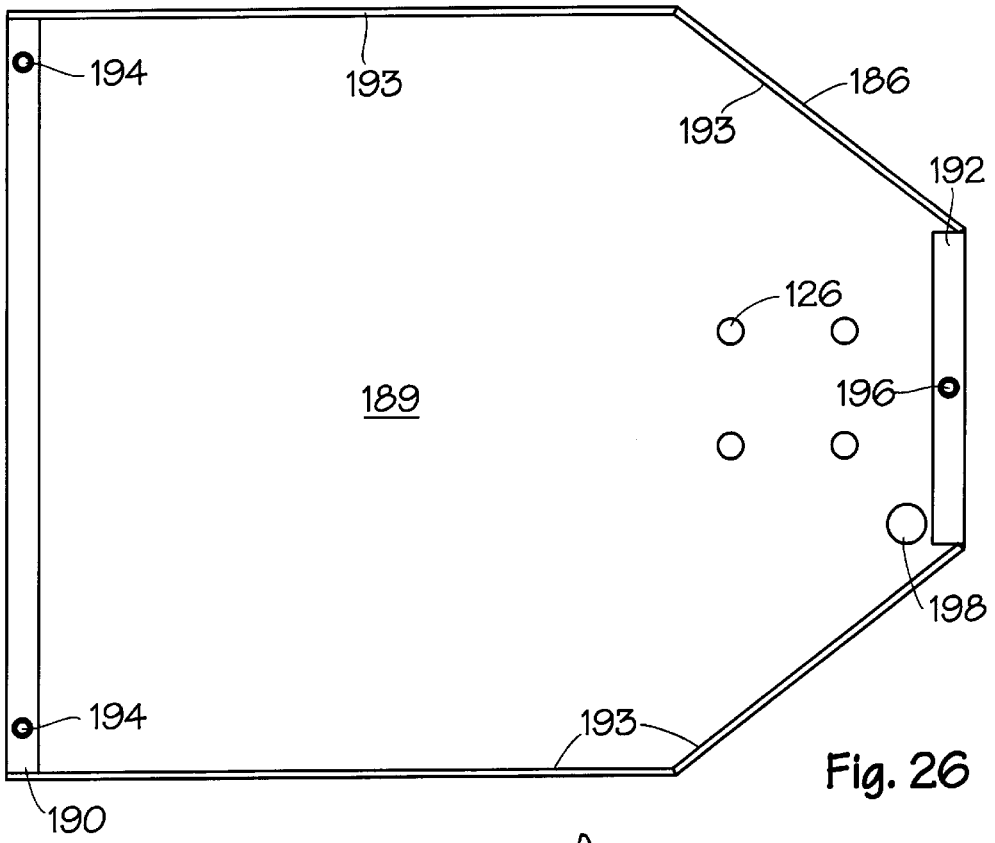
Figure 27:
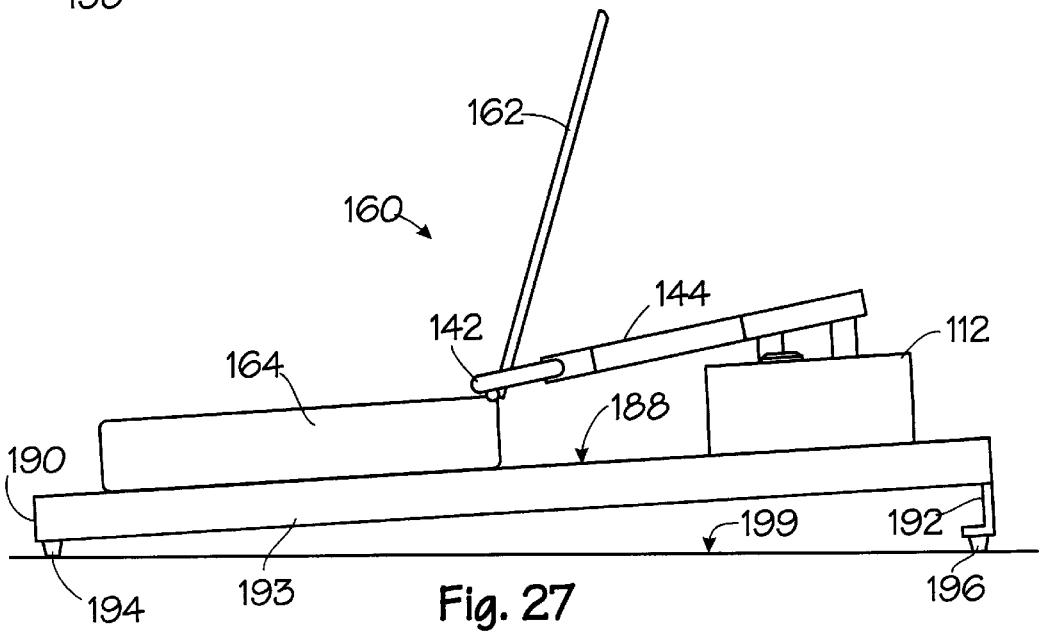

As with the embodiment illustrated in FIGS. 11 through 21, (The security device 110 includes the housing 112 hingedly connected to the base 114 by way of hinge 116, and a retainer 142 connected to a supporting member 144 which is adjustably connected to the housing 112. The lock mechanism employed is the same, having a spring-loaded latch which automatically engages the lock flange 182 when he housing 112 is closed toward the base 114. As shown in FIG. 24, the base 114 is secured to the mini-table 186 by bolts 124 whose smooth heads 126 are exposed on the undersurface 189 of the mini-table 186 (see FIG. 26) but whose nuts 128 become concealed and inaccessible within the housing 112 when it is closed and locked over the base 114 as shown in FIGS. 22, 23 and 27. The manner of operation is the same, except that the retainer 142 secures the computer 160 against the upper surface 188 of the mini-table 186.

The mini-table 186 can be provided with front and rear supports 194,196. The mini-table 186 can easily be manufactured from sheet metal which has been cut and folded at the front and rear sides to provide the front and rear supports 194, 196. For strengthening purposes, vertical walls 193 can be folded downwardly from the sides of the mini-table 186 and welded. The front support 194 is provided with a pair of rubber feet while the rear support has a single foot 96 to provide a stable triangular contact with the surface 199 (see FIG. 27) on which the mini-table is supported. The front support 190 may be shorter than the rear support 92 which will allow the mini-table 186 and, hence, the surface 188 to be inclined to provide the user of the computer 160 with an inclined deck 64 which may facilitate keyboarding. While many laptops 160 are provided with flip-out feet or the like to incline the keyboard, utilization of the computer's feet with any embodiment of the invention is not recommended since, when returned to their position, the height of the deck may be sufficiently below the front retaining member in relation to the surface that the display could be withdrawn from the retainer.

While the size of the mini-table 186 and the appearance of the locking device 110 securing the laptop computer thereto should act as a sufficient deterrent for the majority of potential snatch-and-grab theft situations, for added security, a cable attachment hole 198 may be provided in the mini-table 186 to which a locking cable can be secured, if desired.

Figure 29:
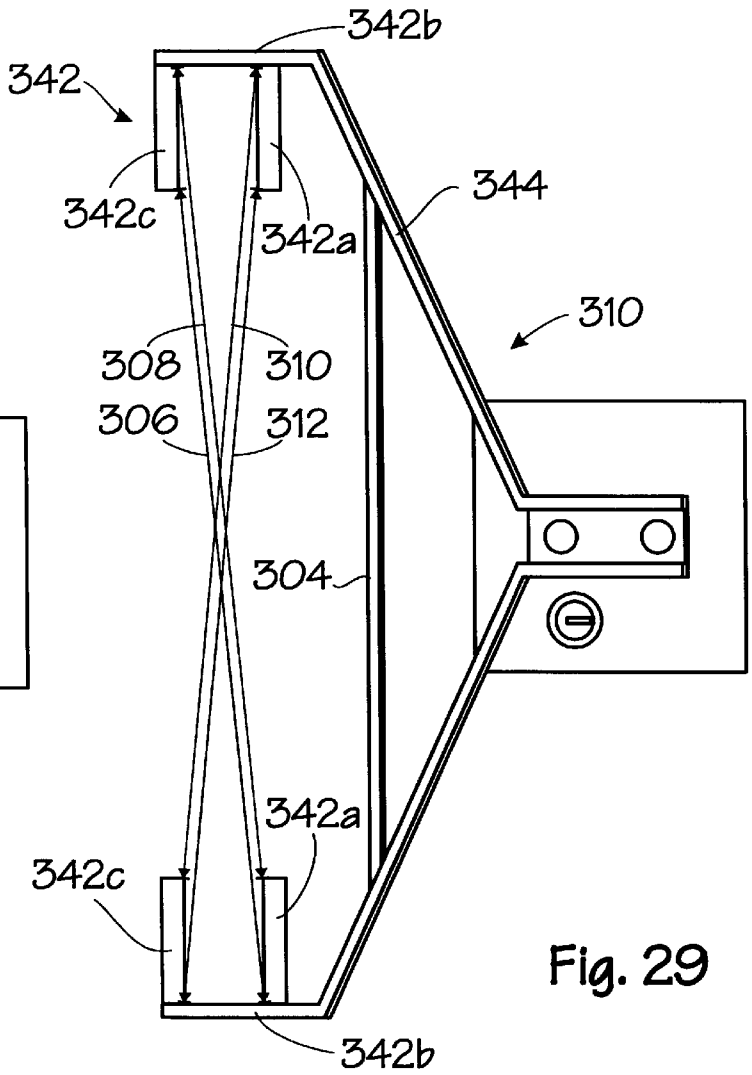
FIGS. 28 and 29 are plan views of the invention showing alternate retaining members.
Figure 28:
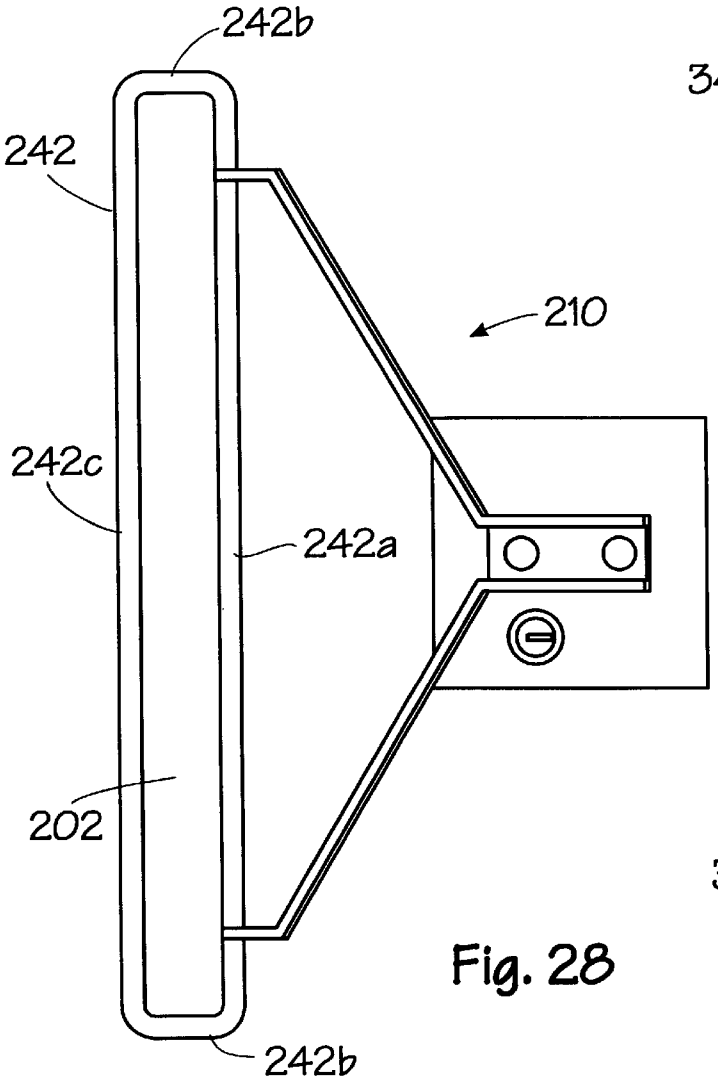

FIGS. 28 and 29 illustrate further embodiments of the device 210, 310 having alternately configured retainers 242,342, respectably. The principles described throughout this application with respect to the configuration of the retainers are equally applicable to either embodiment of the invention whether they pertain to the "closed" retainers 12 and 242 of FIGS. 1 and 28 or the "open" retainers 142 and 342 of FIGS. 23 and 29, and accordingly, the retainers 12,142,242,342 can be employed generally interchangeably with either embodiment The retainer 242 of device 210 is similar to the retainer 142 of device 110 except that the rear, lateral and front members 242*a*,242*b*,242*c* form a closed loop having an aperture 202 through which the display is inserted. This "closed" configuration of the retainer 142 is advantageous since there is no opening through which the display can be maneuvered which is a consideration of the spacing between the front retaining members 142*c* of the C-shaped retainer 142. Therefore, like the retainer 12 of the first embodiment, this arrangement can accommodate a wider range of display widths which are at most slightly narrower tan the distance been the two lateral members 242*b*.

In general, the retainer can be of any shape and configuration which provides the function of preventing the display from being withdrawn once it has been locked in place. The retainer of the present invention does this, in general, by ensuring the display can only be inserted and withdrawn between the enclosing retaining members (and then only when the device has been unlocked) and that it cannot be removed in the direction of the plane in which the retaining members generally lay. As indicated above, the positioning of the retaining members in the locked position is such that the display cannot be withdrawn therefrom due to the spatial relationship between the retaining members and the surface, taking into consideration the size and configuration of the computer and its associated display. The device 310 shown in FIG. 29 further illustrates this principle. The retainer 342 of this device 310 is comprised of a pair of rear retaining members 342*a* which are spaced-apart from a pair of front retaining members 342*c* by lateral members 342*b*, forming in general, a pair of U-shaped, confining members. In this case, a strut 304 is added to the supporting member 344 to resist lateral deformation. Lines 306,308,310,312 represent the dimensional considerations with respect to the minimum display width since a narrower display could be angled out of the retainer 342 through the gap between front members 342*c*,342*c* or between rear members 342*a*,342*a* when there retainer 342 is in its locked position relative to the surface.

While there has been described herein and illustrated in the drawings specific embodiments of the laptop computer security apparatus according to the present invention, it is to be understood that various modifications, adaptations and substitutions may be made thereto without departing from the spirit and scope of the invention as defined in the appended claims. For example, while the devices illustrated herein engage and disengage the computer using a pivoting motion, it is contemplated that other forms of articulation or combinations of linkages could be employed to move the retainer from a first, non-engaging, out-of-the-way position to a second and lockable position securing the computer.

We claim:

1. A security device for securing to a surface a portable computer having a deck and a display pivotably connected thereto, said security device comprising:

retaining means comprising front and rear retaining members spaced-apart by a pair of lateral retaining members, said front, rear and lateral retaining members forming an enclosure with respect to front, rear and lateral directions, said display being insertable through said enclosure;

mounting means securable to a surface;

positioning means connected between said mounting means and said retaining means for providing relative movement of said retaining means with respect to said mounting means, said positioning means being movable from a first position where said retaining means is out of engagement with said display to a second position where said retaining means encloses said display when said computer is resting on said surface, and where said retaining means is positioned in a predetermined orientation above said surface whereby the spatial relationship of the front retaining member with respect to the rear retaining member and the front retaining member with respect to the surface being such that the display, and thereby said portable computer, is incapable of being withdrawn from said retaining means; and locking means for locking said retaining means in said second position.

2. The security device of claim 1, wherein said front, lateral and rear retaining member form a generally rectangular retaining means.

3. The security device of claim 1, wherein said front, lateral and rear retaining member form a generally C-shaped retaining means, said front retaining member comprising two potions spaced apart a predetermined distance, and wherein said predetermined distance, the distance between said front and rear retaining members and the distance between said lateral members is such as to prevent said display from being removed from said retaining means in a frontward direction with respect to said front retaining member.

4. The security device of claim 1, wherein said front, lateral and rear retaining member form a pair of U-shaped member having their openings facing each other, said U-shaped member being spaced apart a predetermined distance, and wherein said predetermined distance, the distance between said front and rear retaining members and the distance between said lateral members is such as to prevent said display from being removed from said retaining means in a frontward direction with respect to said front retaining member and a rearward direction with respect to said rear retaining member.

5. The security device of claim 1, wherein when the retaining mean is locked in said predetermined orientation, said front retaining member is positioned above the surface at a distance which is at or substantially just the height of the deck.

6. The security device of claim 5, wherein, when the retaining means is locked in said predetermined orientation, said rear member is positioned at distance above the surface equal to or greater than the distance at which said front retaining member is positioned above the surface.

7. The security device of claim 1, further comprising adjustment mean associated with said position means for adjusting the predetermined orientation of said retaining means above said surface.

8. The security device of claim 1, wherein said locking means operates automatically to lock said positioning means when said retaining means is moved to said second position.

9. The security device of claim 1, wherein said surface substantially immovable.

10. The security device of claim 1, wherein said surface comprises a mini-table having dimensions substantially greater than the dimensions of a briefcase.

11. The security device of claim 1, wherein said mounting means comprises a mounting structure fastenable to said surface by fasteners, said fasteners having unfastening elements which are accessible when said positioning means is in said first position and inaccessible when said positioning means is in said second position.

12. The security device of claim 1, wherein said mounting means comprises an outer cylinder; and said positioning means comprises:

an inner cylinder positioned coaxially within said outer cylinder and being rotatable therein, said cylinder being longer than said outer cylinder so that first and second ends of said inner cylinder extend outside said outer cylinder; and a pair of support arms extending from said first and second ends of said inner cylinder and being rigidly attached to said retaining means.

13. The security device of claim 12, wherein said outer cylinder is fastened to said surface by a pair of fasteners whose unfastening elements are contained within said outer cylinder, said outer cylinder having a pair of holes through which said unfastening elements are accessible, and wherein said inner cylinder has a pair of circumferentially-disposed slots through which said fasteners extend, said inner cylinder having portions diametrically opposed to said slots, whereby when said retaining means is in said first position, said slots are in registration with said holes in said outer cylinder to permit access to said unfastening elements and when said retaining means is in said second position, said portions of said inner cylinder underlie said holes to prevent access to said unfastening elements.

14. The security system of claim 13, wherein said locking means is operable to lock the inner cylinder against movement with respect to said outer cylinder.

15. The security device of claim 14, wherein said locking means comprises:

a generally cylindrical lock body inserted in one end of said inner cylinder; and a radially movable deadbolt expendable through a hole in said inner cylinder, said deadbolt being engageable with a deadbolt hole provided in said outer cylinder when said positioning means is in said second position.

16. The security device of claim 15, wherein said deadbolt is spring-loaded to engage automatically the deadbolt hole when said positioning means is moved to said second position.

17. The security device of claim 1, wherein said mounting means comprises a base and wherein said positioning means comprises a housing pivotally connected to said base and a supporting member rigidly affixed to said retaining means which extends from said housing, and wherein said locking means is operable to lock said housing to said base to thereby enclose a space.

18. The security device of claim 17, wherein said mounting means is secured to said surface by a plurality of first fasteners whose unfastening elements are disposed relative to the base such that when said housing is locked onto said base, said unfastening elements are inaccessibly contained within said space.

* * * * *